US008763850B2

(12) United States Patent
DePietro

(10) Patent No.: US 8,763,850 B2
(45) Date of Patent: Jul. 1, 2014

(54) PORTABLE MANWAY COVER HINGE DEVICE AND METHODS

(75) Inventor: Edward A. DePietro, Manchester, NH (US)

(73) Assignee: Universal Hinge Corporation, Manchester, NH (US)

( * ) Notice: Subject to any disclaimer, the term of this patent is extended or adjusted under 35 U.S.C. 154(b) by 904 days.

(21) Appl. No.: 12/899,682

(22) Filed: Oct. 7, 2010

(65) Prior Publication Data

US 2011/0017759 A1 Jan. 27, 2011

Related U.S. Application Data

(63) Continuation of application No. 12/697,835, filed on Feb. 1, 2010, now Pat. No. 7,810,671, and a continuation-in-part of application No. 12/102,109, filed on Apr. 14, 2008, now Pat. No. 8,038,031, and a continuation-in-part of application No. 11/736,198, filed on Apr. 17, 2007, now Pat. No. 7,931,168.

(51) Int. Cl.
*B65D 43/16* (2006.01)
*B65D 51/04* (2006.01)

(52) U.S. Cl.
USPC ..... 220/812; 16/248; 16/382; 16/387; 220/817; 220/845; 220/848

(58) Field of Classification Search
USPC ..... 220/812, 845, 848, 817, 644; 16/382, 16/387, 233, 248, 236; 49/38, 39, 190, 49/174, 158, 140, 338, 365
See application file for complete search history.

(56) References Cited

U.S. PATENT DOCUMENTS

| | | | | |
|---|---|---|---|---|
| 1,704,001 | A * | 3/1929 | Holbrook | 49/190 |
| 2,927,787 | A * | 3/1960 | Maher | 49/276 |
| 4,286,727 | A * | 9/1981 | Limoncelli | 220/244 |
| 4,519,519 | A * | 5/1985 | Meuschke et al. | 220/211 |
| 5,092,963 | A * | 3/1992 | Barker et al. | 202/250 |
| 5,228,825 | A * | 7/1993 | Fruchtbaum et al. | 414/684.3 |
| 5,617,963 | A * | 4/1997 | Baziuk et al. | 212/179 |
| 6,786,343 | B1 * | 9/2004 | Porebski et al. | 212/179 |
| 7,556,160 | B2 * | 7/2009 | Porebski et al. | 212/179 |
| 2006/0219649 | A1 * | 10/2006 | Wolfford | 212/166 |

* cited by examiner

*Primary Examiner* — Mickey Yu
*Assistant Examiner* — Niki Eloshway
(74) *Attorney, Agent, or Firm* — Robert R. Deleault, Esq.; Mesmer & Deleault, PLLC

(57) ABSTRACT

A manway cover-manway flange separating kit and method for use with a manway cover handling device includes at least one extended length cover supporting rod having end stops at each end of the cover supporting rod wherein at least one of the end stops is removable and wherein the cover supporting rod is adapted for positioning within one of a plurality of manway cover bolt openings exposed by the removal of a plurality of manway cover bolts and for maintaining alignment of the manway cover and the manway flange when the manway cover is a predefined distance away from the manway flange, and a flange separator including a separator component having a threaded rod and a pair of elongated flange plates, the pair of elongated flange plates rotatably connectable on a first flange plate end to the threaded rod wherein at least one of the pair of elongated flange plates has a threaded opening at the first flange plate end transverse to the flange plate that receives the threaded rod to provide translational movement of the flange plate along the threaded rod.

20 Claims, 36 Drawing Sheets

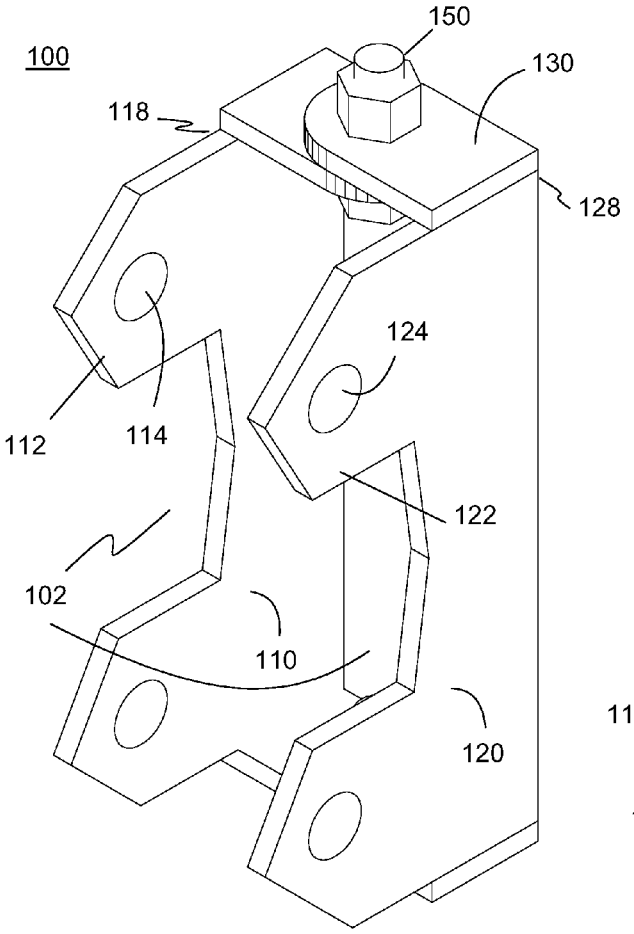
Fig. 15A
Fig. 15B
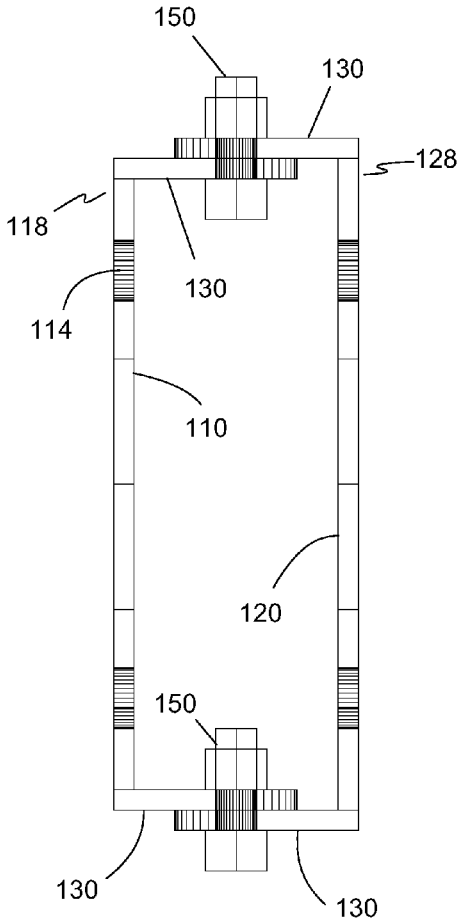

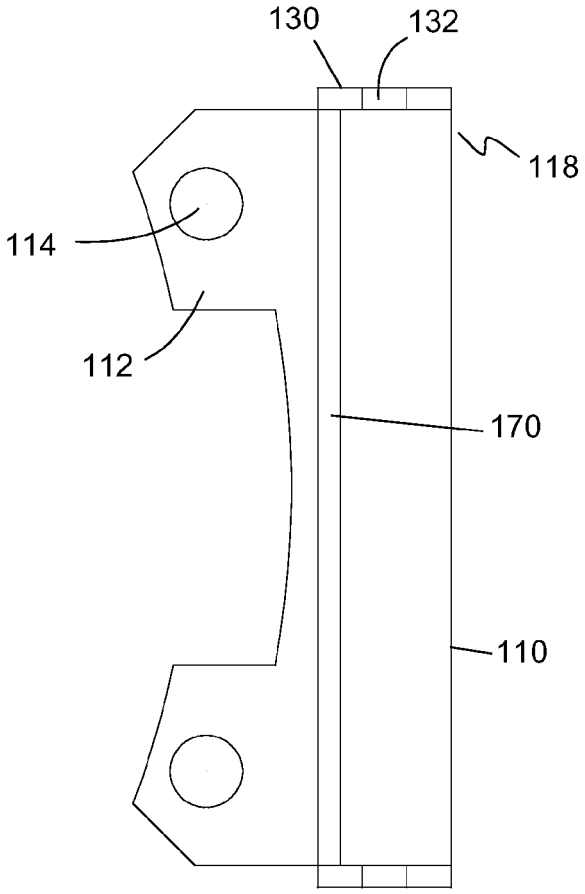
Fig. 18A
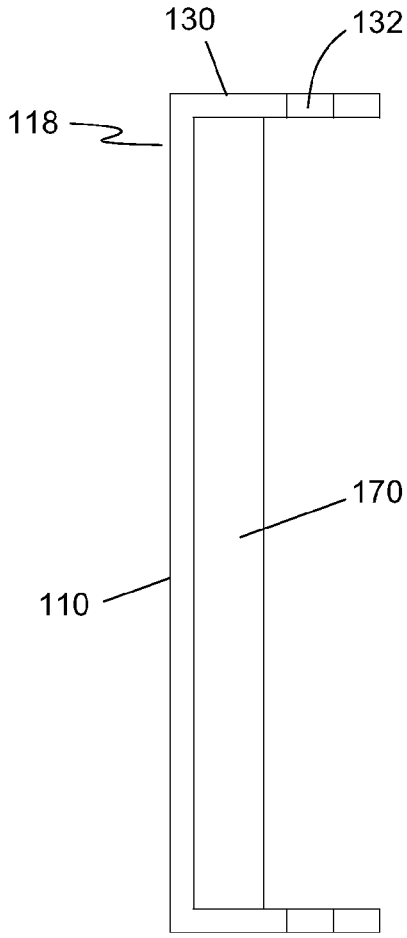
Fig. 18C
Fig. 18B
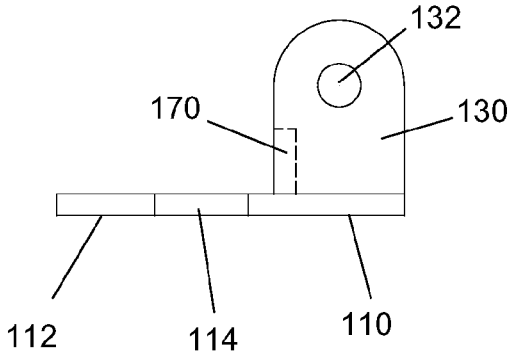

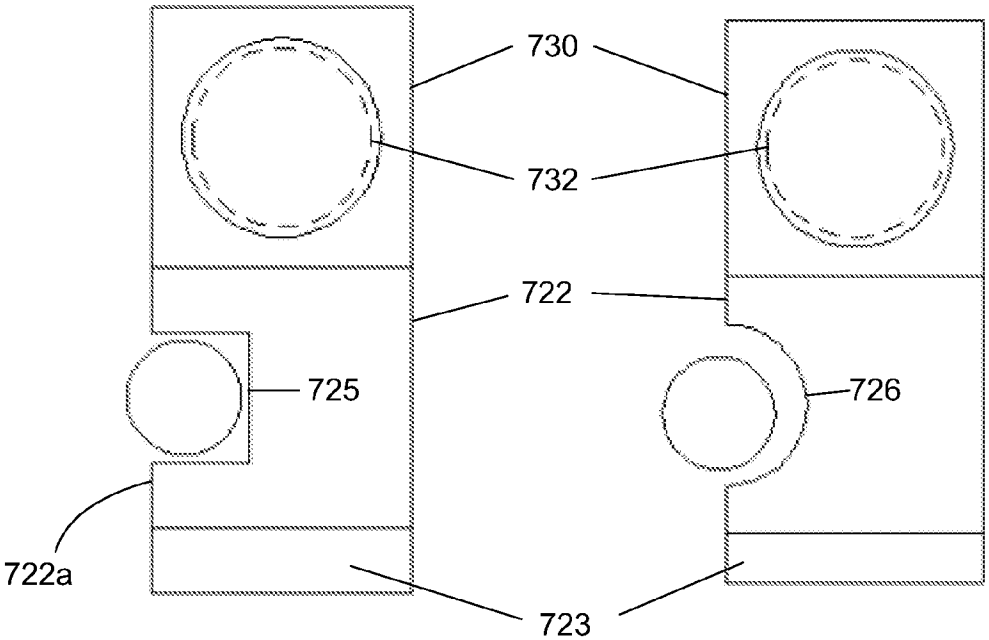
Fig. 44B
Fig. 44A
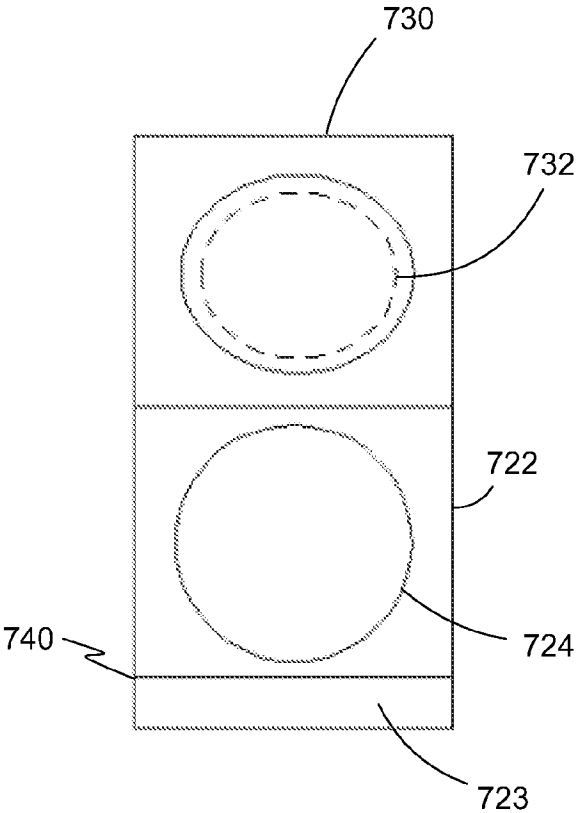
Fig. 43

PORTABLE MANWAY COVER HINGE DEVICE AND METHODS

This application is a Continuation of application Ser. No. 12/697,835 filed on Feb. 1, 2010, which is a Continuation-in-Part application of Ser. No. 12/102,109 filed on Apr. 14, 2008, which is a Continuation-in-Part application of Ser. No. 11/736,198, filed on Apr. 17, 2007.

BACKGROUND OF THE INVENTION

1. Field of the Invention

The present invention relates generally to "manway" covers for access to enclosed spaces such as tanks, conduits, storage areas, heat exchanger tubes. Particularly, the present invention relates to mechanisms to assist in the removal of "manway" covers. More particularly, the present invention relates to mechanisms for handling the removal and installation of "manway" covers that are too heavy to be handled by an unaided individual.

2. Description of the Prior Art

Manway covers are typically large, heavy, metal plates that are bolted to an opening. For purposes of the present invention, the definition of "manway covers" expressly means any heavy covers or closures used on pressure vessels, vacuum vessels, atmospheric vessels, heat exchangers, heat exchanger channel covers, heat exchanger channels, heat exchanger bonnets, heat exchanger shell covers, dished heads, domed heads, half covers such as on divided water box heat exchangers, chiller condensers, chiller heat exchangers, chiller coolers, inspection ports, or any type of blanking plate and is not construed to be limited to only covers used on openings that are dimensionally-sized to allow passage of a man. The most common are circularly-shaped and mate to a flange by way of a plurality of bolts evenly spaced around the periphery of the opening. However, it should be understood that the heavy covers may be any shape. The defined manway covers typically provide access to enclosed spaces such as tanks, conduits, storage areas, transfer tubes, pressure vessels, vacuum vessels, atmospheric vessels, heat exchangers, heat exchanger channel covers, heat exchanger channels, heat exchanger bonnets, and the like. These types of covers are typically found in power plants, co-generation power plants, steam generation plants, chemical plants, petrochemical plants, refineries, pharmaceutical plants, air separation plants, beverage plants, food processing plants, heating and cooling facilities, buildings with central heating and cooling systems, buildings with chiller cooling systems, water treatment plants, waste management plants, dairies, tank farms, gas storage facilities, liquid natural gas storage facilities, manufacturing facilities and or any facility that has tanks, vessels, piping, heat exchangers, chillers, boilers, turbines and/or equipment of similar nature.

Routine servicing and inspection requirements as well as other operating conditions necessitate periodic removal of these covers. In view of the typical location and weight of the covers, it is not a simple task to remove the cover or to re-install the same. Removal is currently accomplished with the use of hand operated davit swing arms, chain falls, ratchet hoists, and brute force. Except for davit swing arms, it is necessary during the removal process to lower the covers a distance to a level surface.

Various devices have been devised to facilitate manway cover removal and re-installation. U.S. Patent Application Publication 2005/0242051 (2005, Porebski et al.) discloses a removable cover support system having a base member and a securing mechanism slidably insertable through at least one of a cover flange hole of a cover assembly, a retaining sleeve connected to the securing base assembly, a swingarm assembly rotatably supported by the retaining sleeve, and a lifting mechanism connected to the swingarm assembly.

U.S. Pat. No. 4,519,519 (1985, Meuschke et al.) discloses a davit assembly that is connected with a transfer tube and a hatch cover to move the cover away. The davit assembly, which is a swingarm, is permanently attached to the outside of the transfer tube.

U.S. Pat. No. 4,297,072 (1981, Shah et al.) discloses a manway handling apparatus having a support arm pivotally mountable on equipment having elliptical manway access openings. The support arm when mounted is swingable toward and away from an access opening and carries a bearing block supporting bracket which is longitudinally adjustably positionable on the arm. The bearing block is vertically adjustably positionable in the bracket and slidably supports a shaft which is attachable to an elliptical cover. The shaft carries structure means which when actuated by turning of a crank handle is effective for tilting the cover and to facilitate its installation and removal.

U.S. Pat. No. 4,865,513 (1989, Norris) discloses a portable manway cover handling apparatus. A boom is mounted within a sleeve for longitudinal translation and the sleeve is hinged to a base plate that is securable by a C-clamp to a superstructure beam in front of a manway cover. A hydraulic actuator bears against the sleeve to adjust its elevation. A powered cable winch is joined to one end of the boom and its cable passes through the boom, which is hollow to the opposite end, and about a pulley to a fastener for attachment to an eye secured in the upper edge of the manway cover. A presser foot is hydraulically actuated to bear against the manway cover with the cable attached to the cover so that the bolts holding the cover in place can be removed. Guide pins are provided for installation in the mounting flange to pilot the cover into registration with the bolt holes when the cover is to be mounted rather than demounted.

The prior art devices suffer from various disadvantages. The swingarm devices are bulky and comprise multiple parts for removably attaching the assembly to the manway or the swingarms are permanently attached to the manway. Other devices are also large, bulky and complicated structures using a boom that requires the base plate of the device to be secured by a C-clamp to a superstructure beam.

Therefore, what is needed is a manway cover handling device that is compact and portable. What is also needed is a manway cover handling device that is easy to attach and remove from a manway only when the manway cover needs to be removed. What is further needed is a manway cover handling device that is relatively lightweight compared to prior art devices. What is still further needed is a manway cover handling device that is simple to assemble.

SUMMARY OF THE INVENTION

It is an object of the present invention to provide a portable manway cover hinge device that can be quickly and easily installed to remove and/or install, support, and/or store a manway cover. It is another object of the present invention to provide a portable manway cover hinge device that can be used in confined or congested areas to remove and/or install, support, and/or store a manway cover. It is a further object of the present invention to provide a portable manway cover hinge device that does not require its use from the floor to remove and/or install, support, and/or store a manway cover. It is still another object of the present invention to provide a portable manway cover hinge device that is portable and that can be used as required in different locations to remove and/or install, support, and/or store a manway cover. It is yet another object of the present invention to provide a portable manway cover hinge device that one man can handle and install for removing and/or installing, supporting, and/or storing a manway cover. It is another object of the present invention to provide a method of supporting the manway cover in a separated state from the manway flange. It is a further object of the present invention to provide a method of easily separating the manway flange from the manway cover.

It is another object of the present invention to provide a portable manway cover hinge device that does not require welding for installation. Given that welding to some equipment structures (pressure vessels and the like) may adversely affect the integrity/reliability of the equipment structure, or re-certification of the equipment structure.

It is a further object of the present invention to provide a portable manway cover hinge device that may be used on non-ferrous and/or non-metallic structures having a manway cover. Since many equipment structures are constructed of non-metallic materials such as Fiberglas™ or other composite materials, a method of manipulating a manway cover in this environment is highly desirable.

It is still a further object of the present invention to provide a portable manway cover hinge device that is relatively universal and can be used on manway covers of various sizes.

The present invention achieves these and other objectives by providing a portable manway hinge device. In one embodiment, the manway hinge device includes a pair of elongated hinge members where each hinge member has a pair of longitudinally-aligned, elongated apertures, a support member slidably connected to each of the elongated apertures where the support member has a pin receiving end, and a linkage member privotally connected to each of the pair of elongated hinge members. An optional pin may be provided or the manway cover bolts may be used as the pins for securing the support members to the manway cover and flange.

For manways having split covers, the present invention also includes an optional component for using two portable manway hinge devices. In one embodiment, the optional component is a hinge connector that connects one hinge member of one hinge device to a serially-aligned hinge component of an adjacent hinge device. The hinge connector may be attached between the two serially aligned hinge components using alignment pins, threaded rods, securing brackets, and the like. In another embodiment, the optional component is a leveling member connected at or adjacent one end of the hinge device. The leveling member on the flange hinge member may be aligned for contact with the peripheral edge of the flange or with the manway extension connected to the flange. The leveling member on the cover hinge member is aligned for contact with the peripheral edge of the cover.

In another embodiment, the portable manway hinge device includes a pair of hinge plates having a plurality of support members where each support member has a hinge aperture adjacent a first side edge of each of the hinge plates, a linkage member adjacent each end of the hinge plates and extending out of the plane of the hinge plate adjacent a second side edge of each of the hinge plates, and a pivotal connection coupling overlapping pairs of the linkage members of the pair of hinge plates. The pivotal connection may be a pivotal pin that is inserted into a linkage aperture in each pair of overlapping linkage members or it may be a single pivotal pin that extends and couples each overlapping pair of linkage members associated with a hinge device. Additionally, the linkage members of each of the pair of hinge plates may be nested or offset. Each hinge plate may optionally include a plate stiffener. In one embodiment, the plate stiffener extends out of the plane of the hinge plates between the linkage members to reinforce the hinge plate and the linkage members. In another embodiment, the plate stiffener extends out of the plane of the hinge plates on a side opposite the linkage members and further extends over the outside surface of the linkage member to also reinforce the hinge plate and the linkage members. The linkage member can be a plate with a linkage aperture or a rod with one end attached to the hinge plate and the other end with a linkage pin receiving aperture. The plurality of hinge plate apertures are spaced to align with the bolt holes of the manway cover to which the hinge device attaches.

In still another embodiment, the portable manway hinge device includes a pair of hinge plates containing a plurality of hinge apertures adjacent a first side edge of each of the hinge plates, a pair of linkage members having a linkage member tab extending away from a linkage member body where the linkage member tab extends through a linkage member slot in the hinge plate, and optional adjustment spacers mountable between the linkage member body of the removable linkage member and the side of the hinge plate. The optional adjustment spacers allow attachment of the hinge device to a wide variety of cover and flange thicknesses.

In yet another embodiment, the portable manway hinge device of any of the previous embodiments has a pair of hinge plates where one of the plurality of hinge apertures adjacent a first side edge of the hinge plates is a hinge attachment slot. The slot is used to accommodate the difference in vertical spacing of the bolt holes in a cover and a flange as well as the vertical spacing where a cover's bolt holes are spaced differently than the flange bolt holes.

In another embodiment, the portable manway hinge device is a split hinge device that includes an upper hinge support and a lower hinge support. Each of the upper hinge support and the lower hinge support has a pair of split hinge plates with at least a linkage member at one end of each of the split hinge plates and a pivotal connection coupling overlapping pairs of the linkage members of each of the pair of split hinge plates. The pivotal connection may be a pivotal pin for each pair of overlapping linkage members or it may be a single pivotal pin that extends and couples each overlapping pair of linkage members associated with the split hinge device. The linkage members of each of the pair of split hinge plates may be nested or offset. Each hinge plate may optionally include a plate stiffener, as previously disclosed.

In all embodiments of the present invention, an optional pin may be provided or the manway cover bolts may be used as the pins for securing the support members to the manway cover and flange. The pin may be threaded, tapered, unthreaded rods and/or bolts, expanding plugs, and the like.

By using the bolt holes on the cover and cover flange, one of the main advantages of the present invention is that the present invention does not require welding of the hinge device to the equipment with the removable cover.

In one embodiment there is describe a method of handling the removal and installation of a manway cover to a manway flange. The method includes removing a plurality of manway cover bolts from a portion of the manway cover that is located to one side of a vertical axis of the manway cover, providing a flange hinge plate of a portable manway cover hinge device with at least one hinge plate aperture therethrough, aligning the at least one hinge aperture of the flange hinge plate with a bolt opening in the manway flange, inserting a pin first end of a hinge plate fastening pin through the at least one hinge aperture and into the aligned bolt opening in the manway flange where the pin first end has a bore transverse to the longitudinal axis of the pin and extending beyond the manway flange, inserting a transverse rod into the bore of the pin, securing the flange hinge plate to the manway flange, providing a cover hinge plate of a portable manway cover hinge device where the cover hinge plate has at least one hinge plate aperture therethrough, aligning the at least one hinge aperture of the cover hinge plate with a bolt opening in the manway cover, inserting a pin first end of another hinge plate fastening pin through the at least one hinge aperture and into the aligned bolt opening in the manway cover and securing the cover hinge plate to the manway cover, pivotally connecting the flange hinge plate to the cover hinge plate, and removing any remaining manway hardware from the manway cover and the manway flange that prevents the manway cover from pivotally opening away from the manway flange.

In another embodiment, the method includes inserting a pin having a structure selected from the group consisting of a tapered pin, a straight pin, an eccentric pin, a concentric pin, an expandable pin, a bolt, a bolt with a nut, a partially threaded bolt with a nut, a bolt with a tapered nut, a partially threaded bolt with a tapered nut, a threaded rod with at least one nut, a partially threaded rod with at least one nut, a threaded rod with at least one tapered nut, and a partially threaded rod with at least one tapered nut.

In a further embodiment of the present invention, the method includes forming a flange bore transverse to the perimeter of the manway flange that penetrates at least into the bolt opening of the manway flange before receiving the hinge plate fastening pin having a bore in the pin first end and aligning the bore of the fastening pin with the flange bore when inserting the pin into the aligned bolt opening before inserting the transverse rod.

In another embodiment, the method includes removing a plurality of upper manway cover bolts from a portion of the manway cover, inserting at least one extended length cover supporting rod into one of a plurality of upper manway cover bolt openings exposed by the removal of the plurality of upper manway cover bolts, providing end stops at each end of the cover supporting rod, removing the remaining manway cover bolts from the manway cover, and separating the manway cover a predefined distance from the manway flange before aligning the at least one hinge aperture of the flange hinge plate with a bolt opening in the manway flange.

In still another embodiment, the method includes inserting a separator component of a flange separator between the manway flange and the manway cover. The flange separator includes a threaded rod and a separator component having a pair of elongated flange plates rotatably connected on one end to the threaded rod wherein at least one of the pair of elongated flange plates has a threaded opening at the one end transverse to the flange plate that receives the threaded rod to provide translational movement of the flange plate along the threaded rod, and turning the threaded rod causing translational movement of the flange plate forcing separation between the pair of elongated flange plates that causes the manway cover to slide away from the manway flange on the at least one extended length cover supporting rod toward the end stop.

In yet another embodiment, the method includes forming a flange separator where each of the pair of elongated flange plates has a threaded opening at one end adapted to cause each of the pair of elongated flange plates to move along the threaded rod either towards each other or away from each other depending on the directional rotation of the threaded rod.

In another embodiment, the method includes forming a threaded rod having a right-hand thread along a first portion of the threaded rod and a left-hand thread along a second portion of the threaded rod wherein each of the first portion and the second portion engages one of the pair of elongated flange plates.

In a further embodiment, the method includes forming a right-hand threaded opening in one of the pair of elongated flange plates and a left-hand thread opening in the other of the pair of elongated flange plates.

Another embodiment of the method includes forming one of a notch or an opening in at least one of the pair of elongated flange plates.

In a further embodiment, the method includes forming an angled taper at an end of each of the pair of elongated flange plates opposite the end with the threaded opening where, when the pair of elongated flange plates are located adjacent to and contact each other, the combination of the ends with the angled taper of each of the pair of elongated flange plates forms a wedge for inserting between the manway cover and the manway flange.

In still another embodiment, the method includes forming an elongated opening in each of the transverse plate flanges that extend in the same direction from opposite ends of the cover hinge plate and where each of the transverse plate flanges matingly receives one of the transverse plate flanges of the flange hinge plate. The transverse plate flanges of the flange hinge plate have a pivot receiving opening and which extend in the same direction from opposite ends of the flange hinge plate. The method includes inserting a pivot post into the elongated opening and the pivot receiving opening that are matingly received to each other.

In another embodiment, the method includes forming a flange plate that is circularly shaped with a central interface end and a peripheral flange end. The central interface end has a rotation interface and the peripheral flange end has a beveled edge.

In a further embodiment, the method includes forming a modified pin or cover supporting rod. The modified pin or cover supporting rod has a central portion, a tapered portion and a reduced diameter portion that is smaller than the diameter of the central portion.

In yet another embodiment, the method includes forming a pivot support pin for use with a hinge device for a horizontally mounted manway cover that mounts between the flange hinge plate and the cover hinge plate.

BRIEF DESCRIPTION OF THE DRAWINGS

FIG. 15A is a perspective view of another embodiment of the present invention showing the major components of the hinge device.

FIG. 15B is a front view of the embodiment in FIG. 15A.

FIGS. 18A, 18B and 18C are a side view, an end view and a rear view, respectively, of the hinge plate of the embodiment in FIG. 15A showing an internal plate stiffener.

FIG. 43 is a front view of another embodiment of an elongated flange plate of a flange separator of the present invention showing a through opening in the elongated flange plate.

FIGS. 44A, 44B and 44C are front views of other embodiments of elongated flange plates showing notches formed into the elongated flange plate.

DETAILED DESCRIPTION OF THE PREFERRED EMBODIMENT

Figure 1:
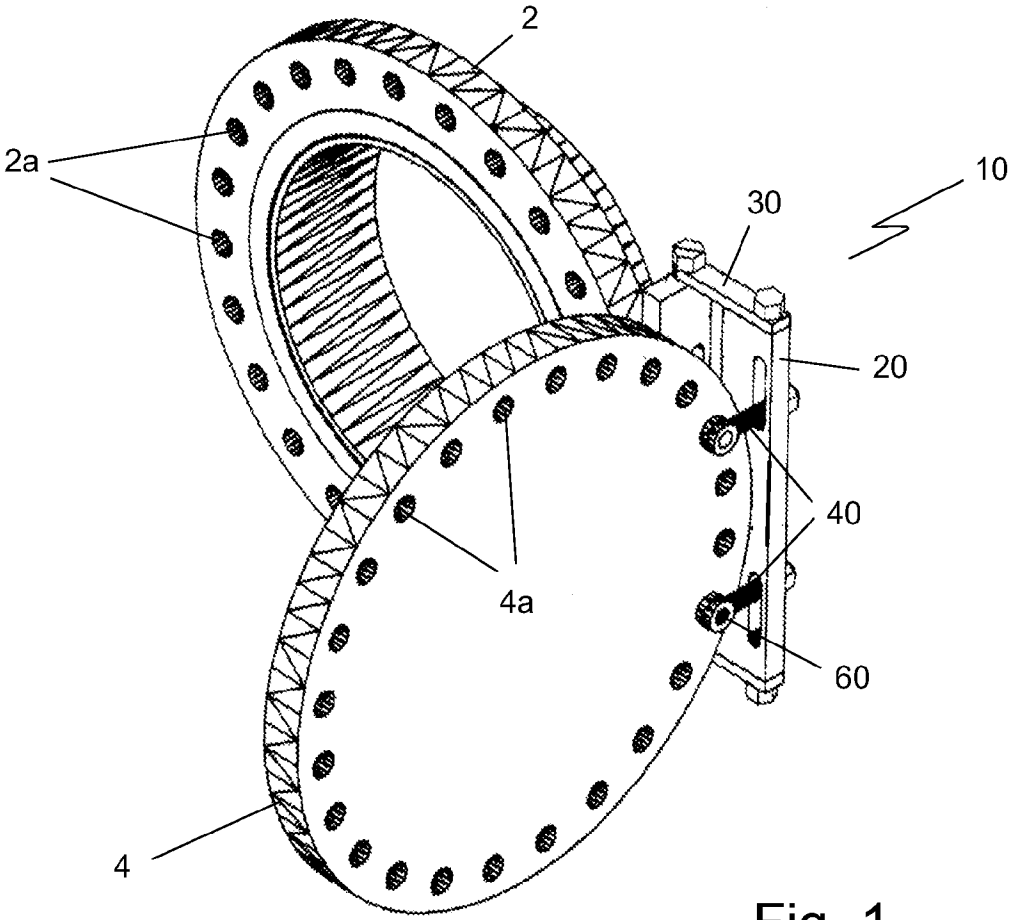
FIG. 1 is a perspective view of one embodiment of the present invention attached to a manway flange and manway cover showing the manway cover in an open and supported position.

The preferred embodiment(s) of the present invention is illustrated in FIGS. 1-51. FIG. 1 illustrates the use of a portable manway cover hinge device 10 on a manway. Hinge device 10 includes a pair of elongated hinge members 20, a linkage member 30 and a plurality of support members 40. One of the elongated hinge members 20 is connected to a manway cover flange 2 and the other of the elongated hinge members 20 is connected to the peripheral edge of manway cover 4. Linkage member 30 is pivotally connected to the pair of elongated hinge members 20 and configured to swing manway cover 4 away from manway opening 6 providing access to the inside of the manway structure. A plurality of pins 60 secure a plurality of support members 40 to a plurality of bolt holes 2*a* and 4*a* in manway flange 2 and manway cover 4, respectively.

Figure 2:
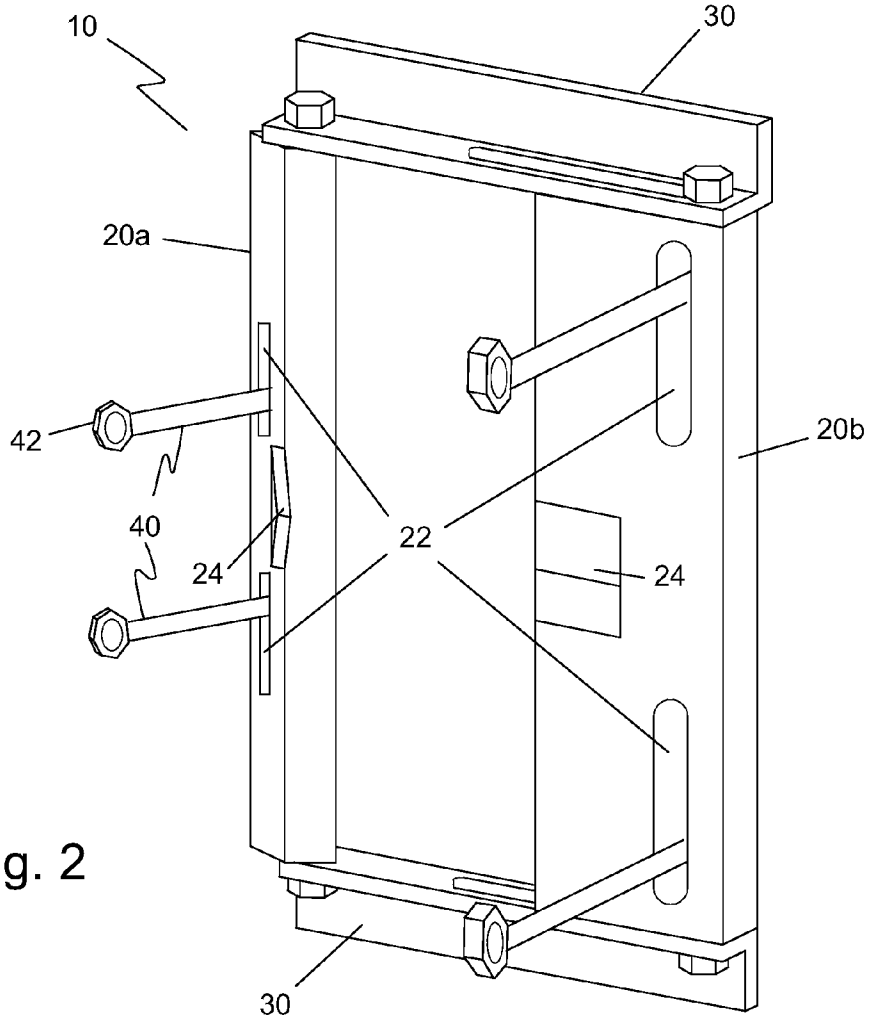
FIG. 2 is a perspective view of the present invention showing the major components of the hinge device.

FIG. 2 illustrates the portable manway cover hinge device 10. Hinge device 10 includes a pair of elongated hinge members 20 comprising a flange hinge member 20*a* and a cover hinge member 20*b*. A linkage member 30 connects flange hinge member 20*a* to cover hinge member 20*b* at each end. Linkage member 30 maintains the proper spacing between the elongated hinge members 20 while being configured to pivot the pair of elongated hinge members 20 relative to each other. The elongated hinge members 20 each have a pair of longitudinally-aligned apertures 22 therethrough. Each longitudinally-aligned aperture 22 has a support member 40 received therethrough for connecting the hinge device 10 to the manway flange 2 and the manway cover 4. Support member 40 has a pin receiving end 42 that is used for connecting to manway flange 2 and manway cover 4. As can be seen from FIG. 2, flange hinge member 20*a* and cover hinge member 20*b* have an optional recessed portion 24 in the surface of the members 20*a*, 20*b* positioned approximately at the middle of hinge members 20 inward from a longitudinal edge that is furthest from the longitudinally-aligned apertures 22.

Figure 3:
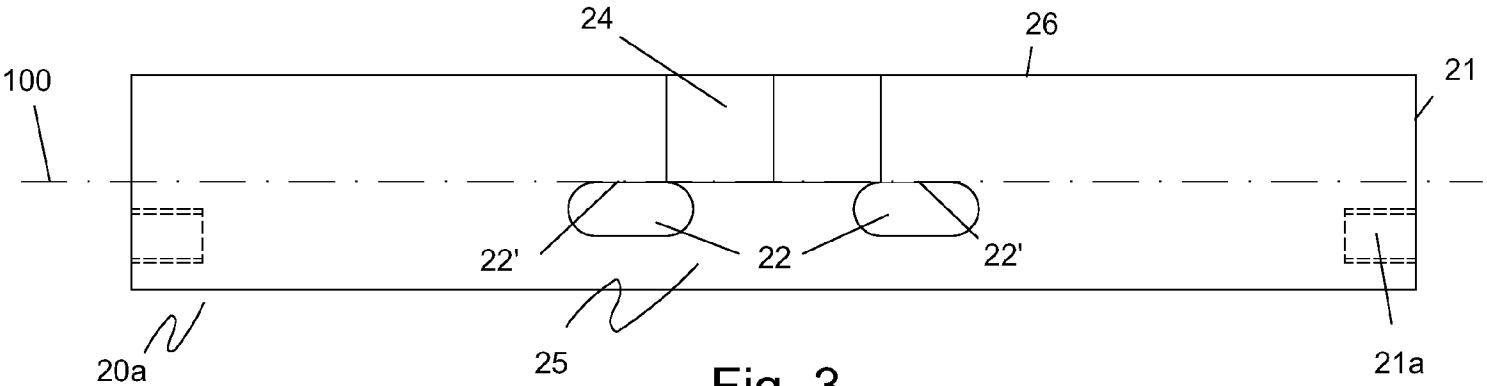
FIG. 3 is a front view of one embodiment of the elongated hinge member of the present invention showing the longitudinally-aligned, elongated apertures located within a central portion of the hinge member.

FIG. 3 is a front view of flange hinge member 20*a*. Flange hinge member 20*a* has longitudinally-aligned apertures 22 preferably positioned within a central portion 25 of flange hinge member 20*a* where one of the elongated sides 22' of apertures 22 are located along a longitudinal center line 100 of flange hinge member 20*a*. Apertures 22 are spaced from each other to provide adjustability for use on manway covers of different sizes, which typically would have different spacing between radial cover bolt locations depending on the size of the manway cover. The elongated apertures 22 are configured to adjust for the difference in distance between the bolts of the cover 4. Optional recessed portion 24 is located in central portion 25 on the opposite side of longitudinal center line 100 from apertures 22. Preferably, recessed portion 24 is contiguous to member edge 26. Each hinge member end 21 has an end recess 21 a for receiving a fastener that connects linkage member 30 (not shown) to flange hinge member 20*a*.

Figure 4:
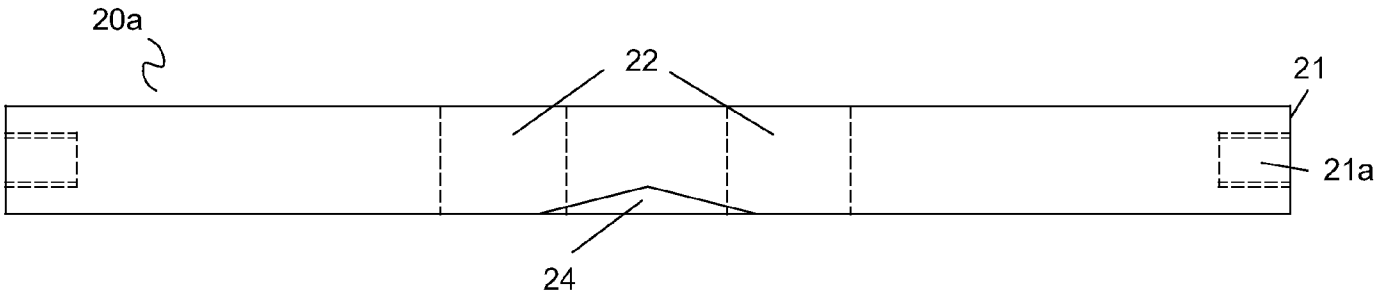
FIG. 4 is a side view of the elongated hinge member shown in FIG. 3.
Figure 5:
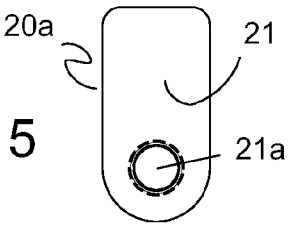
FIG. 5 is an end view of the elongated hinge member shown in FIG. 3.

FIG. 4 is a side view showing optional recessed portion 24. As illustrated, optional recessed portion 24 is V-shaped but could also be any shape that provides a surface for positioning against the peripheral edge of the manway flange 2 or cover 4. Apertures 22 pass completely through flange hinge member 20*a* and are elongated to provide spacing for longitudinal adjustment of a support member 40 (not shown). FIG. 5 is an end view of flange hinge member 20*a* showing the end recess 21*a*. End recess 21*a* is preferably a threaded recess but may, in the alternative, be configured for a removable compression fitting.

Figure 6:
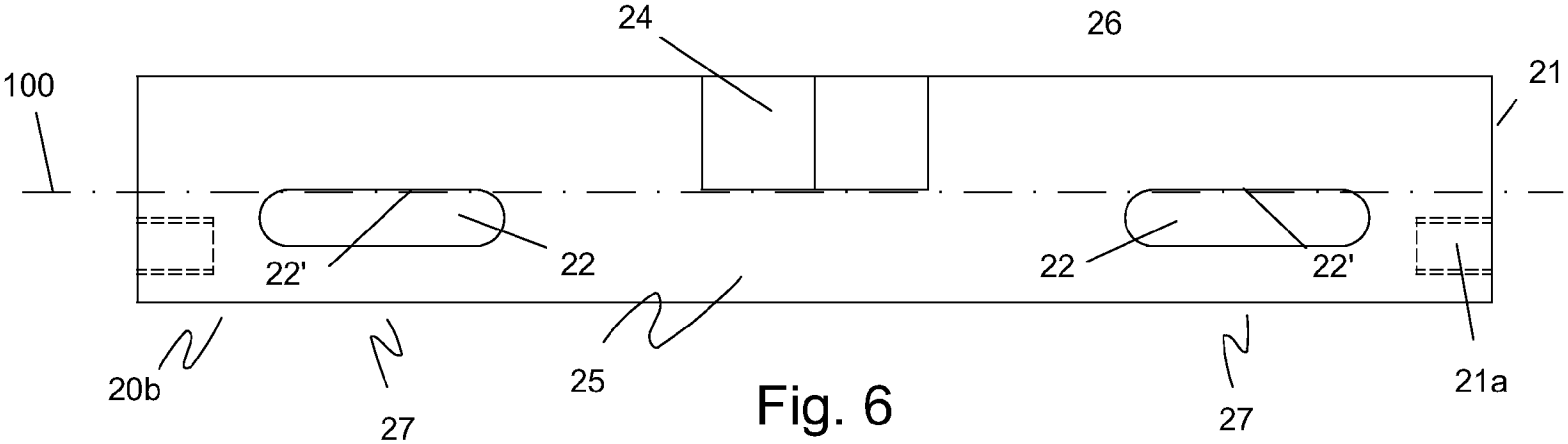
FIG. 6 is a front view of another embodiment of the elongated hinge member of the present invention showing the longitudinally-aligned, elongated apertures locate within the end portion of the hinge member.

FIG. 6 is a front view of cover hinge member 20*b*. Cover hinge member 20*b* has longitudinally-aligned apertures 22 preferably positioned within an end portion 27 of cover hinge member 20*b* where one of the elongated sides 22' of apertures 22 are located along a longitudinal center line 100 of flange hinge member 20*b*. Apertures 22 are spaced from each other to not only provide adjustability for use on manway covers of different sizes, but also to provide better support for manway cover 4 and prevent inadvertently aligning a support member 40 of cover hinge member 20*b* with a support member 40 of flange hinge member 20*a*. Like elongated apertures 22 in flange hinge member 20*a*, the elongated apertures 22 of cover hinge member 20*b* are configured to adjust for the difference in distance between the bolts of the cover 4. Cover hinge member 20*b* may also have optional recessed portion 24. Optional recessed portion 24 is located in central portion 25 on the opposite side of longitudinal center line 100 from apertures 22. Preferably, recessed portion 24 is contiguous to member edge 26. Each hinge member end 21 has an end recess 21*a* for receiving a fastener that connects linkage member 30 (not shown) to cover hinge member 20*b* and may be configured to receive a fastener as are known to those skilled in the art to support attachment with linkage member 30.

Figure 7:
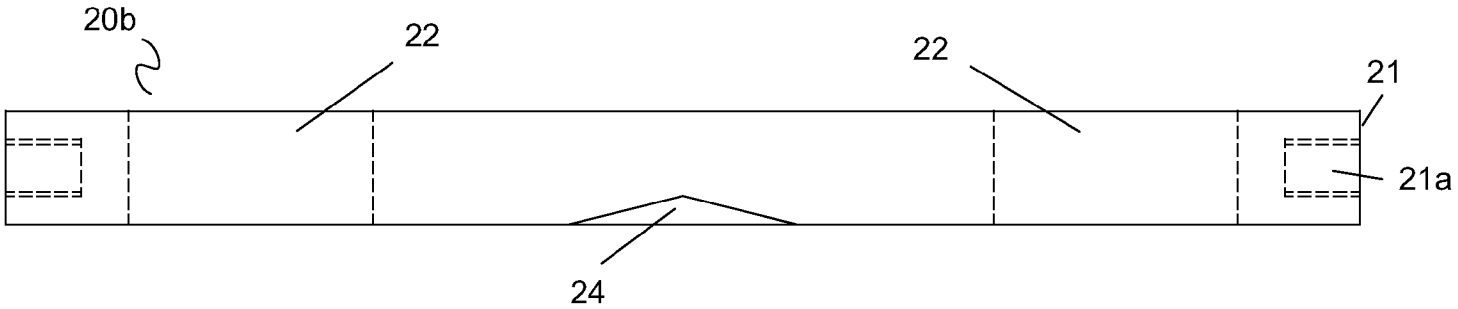
FIG. 7 is a side view of the elongated hinge member shown in FIG. 6.
Figure 8:
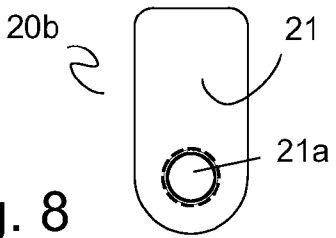
FIG. 8 is an end view of the elongated hinge member shown in FIG. 6.

FIG. 7 is a side view showing optional recessed portion 24. As illustrated, optional recessed portion 24 is V-shaped but could also be any shape that provides a surface for positioning against the peripheral edge of the manway cover 4. Apertures 22 pass completely through cover hinge member 20*b* and are elongated to provide spacing for longitudinal adjustment of a support member 40 (not shown). FIG. 8 is an end view of cover hinge member 20*b* showing the end recess 21 a. As illustrated in the Figures, flange hinge member 20*a* and cover hinge member 20*b* are similar except for the location of the longitudinally-aligned apertures 22. This simplifies manufacturing of the components and, thus, reduces cost.

Figure 9:
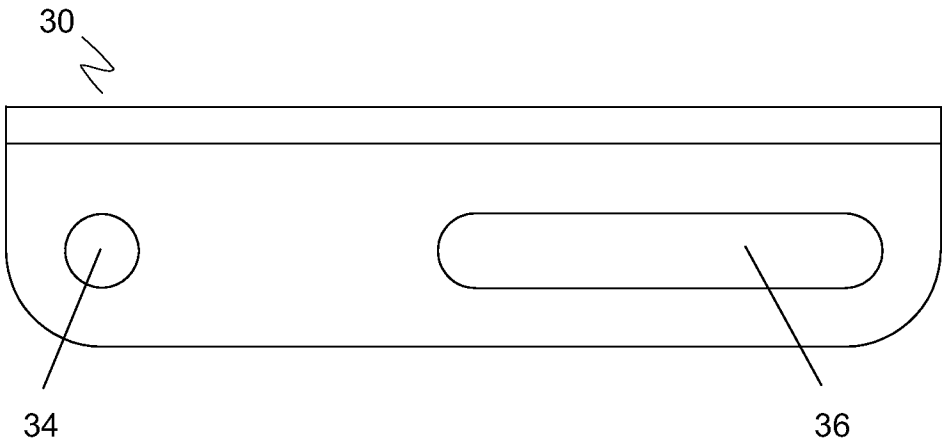
FIG. 9 is a top view of one embodiment of the linkage member of the present invention showing an adjustment slot.

Turning now to FIG. 9, there is illustrated a top plan view of linkage member 30. Linkage member 30 has a first linkage aperture 34 near one end and a second linkage aperture 36 near the opposite end. Second linkage aperture 36 is preferably an elongated slot, which provides a mechanism for adjusting the distance between flange hinge member 20*a* (not shown) and cover hinge member 20*b* (not shown) depending on the size/thickness of the manway flange 2 and the manway cover 4. First linkage aperture 34 and second linkage aperture 36 are configured to receive fasteners that attach linkage member 30 to the ends 21 of flange hinge member 20*a* and cover hinge member 20*b*.

Figure 10:
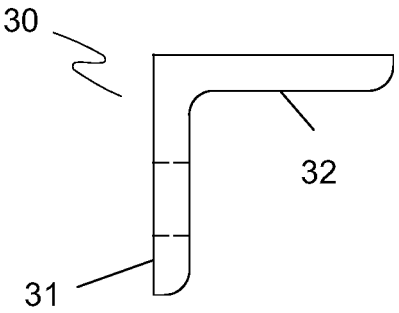
FIG. 10 is an end view of the linkage member shown in FIG. 9.

FIG. 10 is an end view of linkage member 30. FIG. 10 illustrates linkage member 30 as being an L-shaped linkage having a first leg 31 and a second leg 32. It should be noted that linkage 30 may be flat instead of L-shaped or it may be tubular. The purpose of linkage member 30 is to connect flange hinge member 20*a* to cover hinge member 20*b* where hinge members 20*a* and 20*b* are pivotably connected to swing cover 4 away from fange 2.

Figure 11:
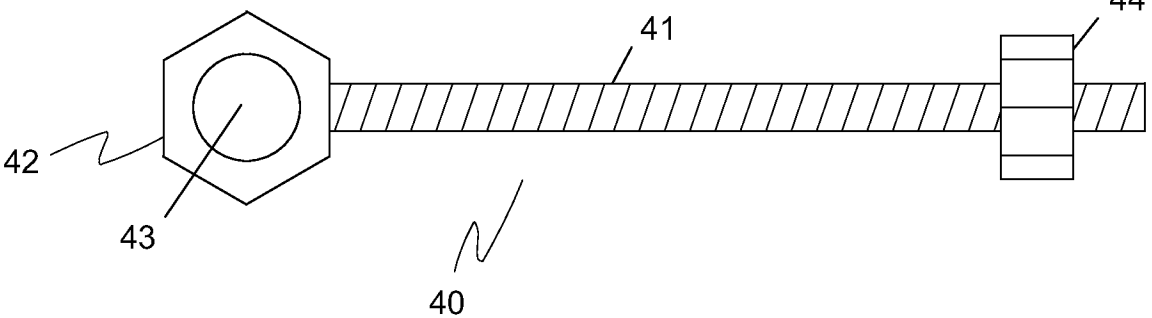
FIG. 11 is a side view of one embodiment of a support member of the present invention showing a pin receiving end.

FIG. 11 is a side view of a support member 40. Preferably, support member 40 has a threaded rod 41 with a pin receiving end 42. Pin receiving end 42 has a pin receiving aperture 43. Optionally, pin receiving aperture 43 may be threaded to accept a bolt similar to the bolts that secure the manway cover 4 to manway flange 2 (or may be the cover bolts themselves). The bolt acts as a pin 60 for connecting support member 40 to the manway flange 2 and manway cover 4. A support member nut 44 is configured for threadable attachment to threaded rod 41 and used to retain support member 40 within the elongated apertures 22 of hinge members 20*a*, 20*b*.

Figure 12:
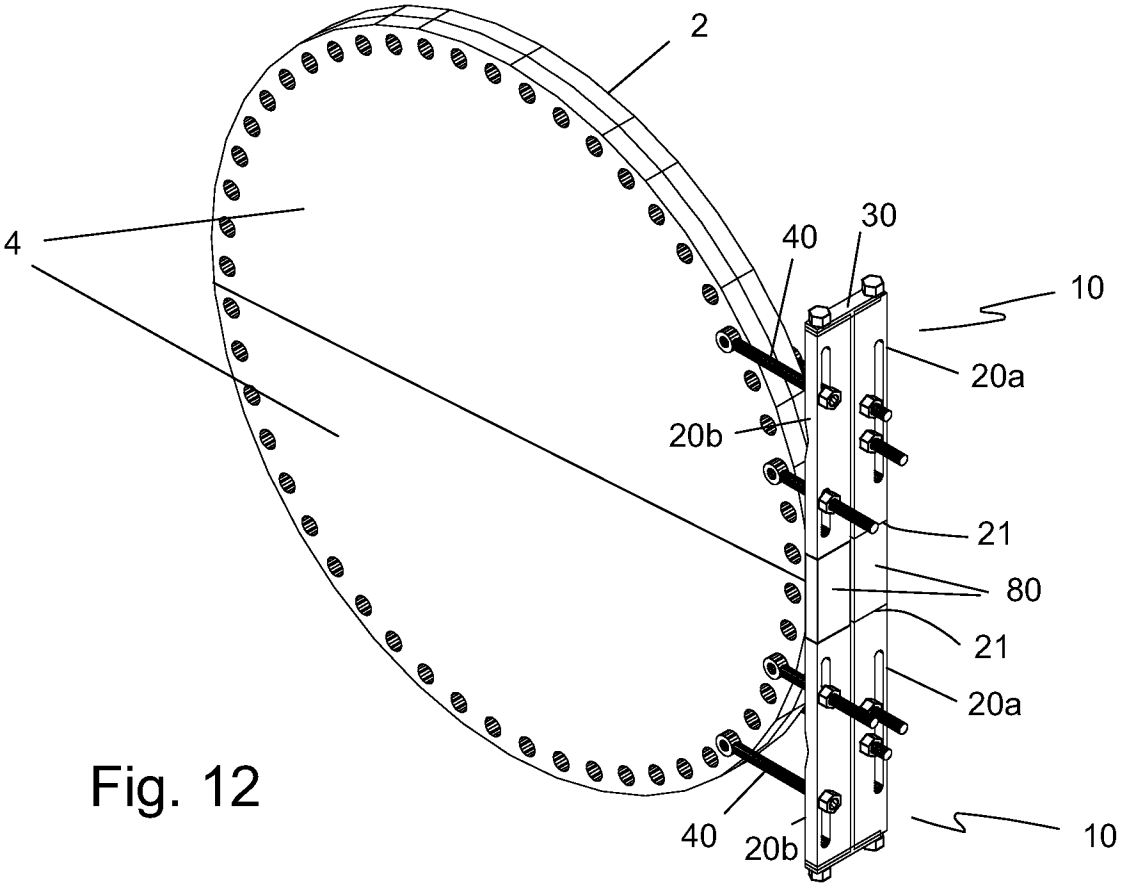
FIG. 12 is a perspective view of another embodiment of the present invention showing a connecting member between a pair of serially aligned hinge devices and mounted on a split manway cover and a manway flange with the cover in the closed position.
Figure 13:
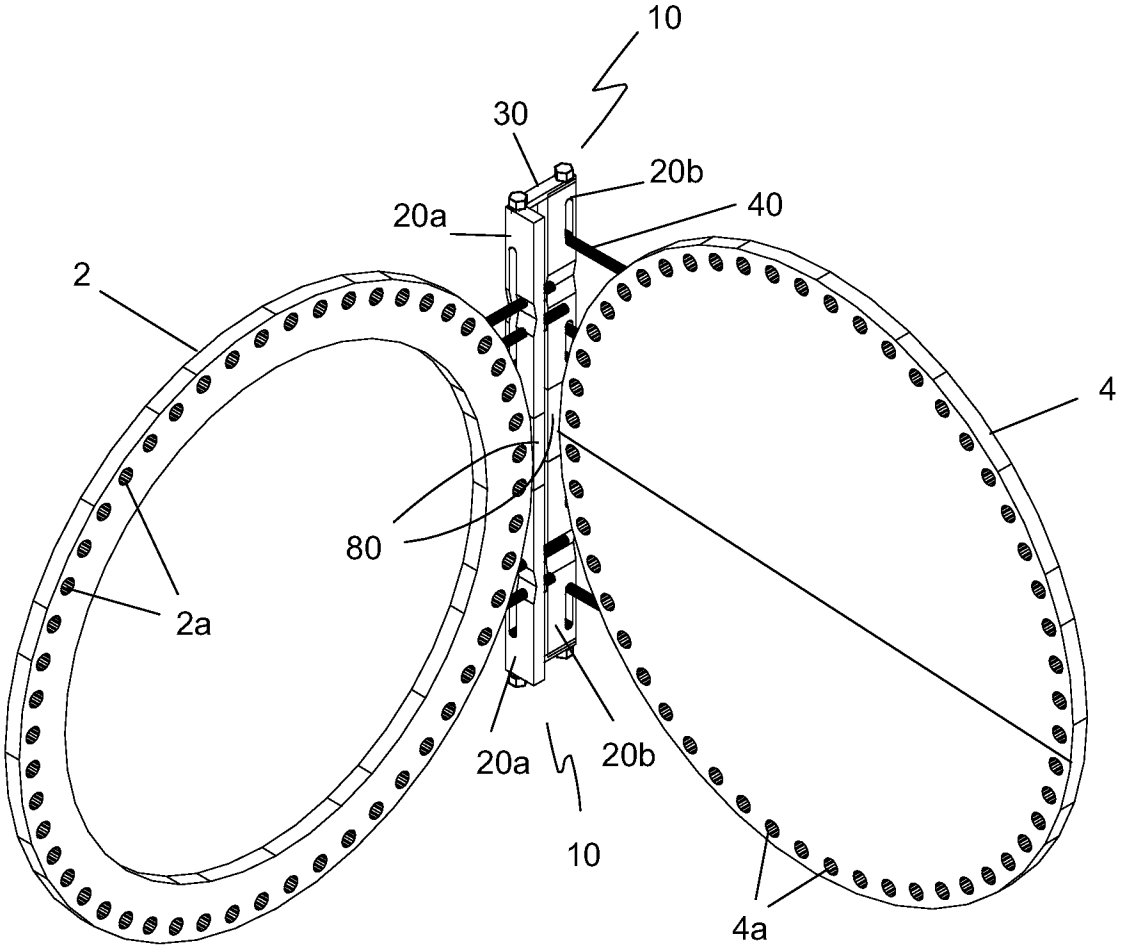
FIG. 13 is a perspective view of the embodiment of the present invention shown in FIG. 12 showing the split manway cover in an open position.

In some situations, a manway cover is a split cover. The present invention may also be used on split manway covers by providing a slight modification to the manway cover hinge device 10. FIG. 12 illustrates one embodiment of such a modification. FIG. 12 shows a manway cover 4 in position against a manway cover flange 2. Two hinge devices 10 are used in this situation. Hinge devices 10 are serially aligned end to end with each other. A hinge connector 80 is removably attached to each end 21 of flange hinge member 20*a* and cover hinge member 20*b* between the two serially aligned hinge devices 10 and provides a surface against which the peripheral edge of manway flange 2 and manway cover 4 make contact. Hinge connector 80 may be connected to hinge devices 10 with alignment pins, threaded rods, tubular brackets, and the like (not shown). FIG. 13 is a perspective view of the embodiment in FIG. 12 showing the manway cover 4 pivotally moved away from manway cover flange 2.

Figure 14:
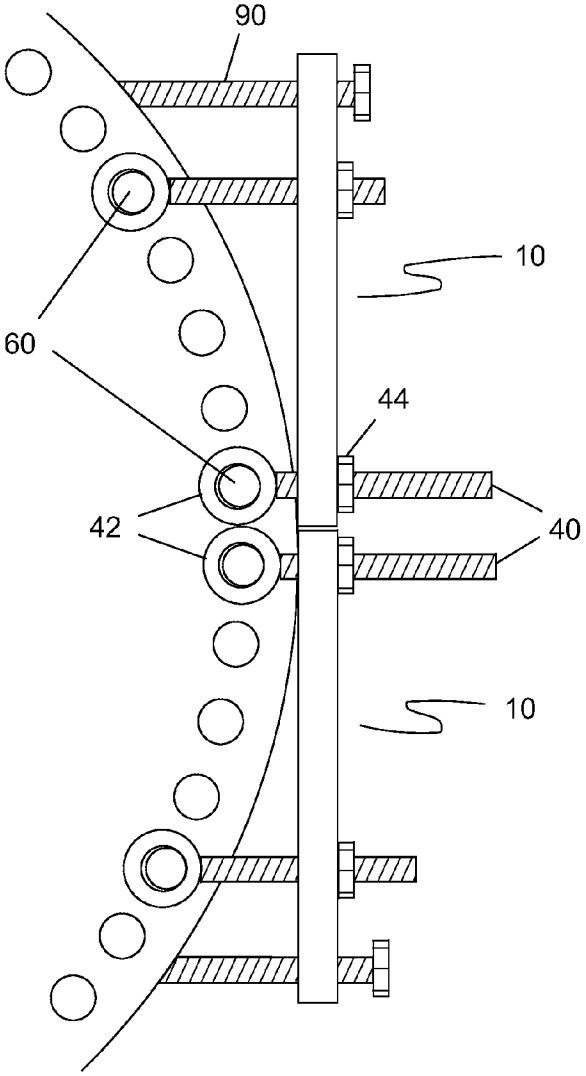
FIG. 14 is a side view of another embodiment of the present invention for use with a split manway cover in a closed position showing the use of a leveling member at or adjacent the end of the elongated hinge member.

FIG. 14 is a side view of another embodiment of the present invention for use with split manway covers. In this embodiment, hinge devices 10 are serially aligned and adjacent to each other but not connected together. Instead, each hinge device has a leveling member 90 attached to an end portion 27 of flange hinge member 20*a* and cover hinge member 20*b*. In the embodiment illustrated in FIG. 14, leveling member 90 is a set screw. Leveling member 90 of flange hinge member 20*a* may contact the peripheral edge of manway flange 2 or to the extension tube (not shown) to which manway flange 2 is attached. In this illustration, there is also shown the use of a pin 60 through the bolt holes of manway cover 4 and manway flange 2. Leveling member 90 of cover hinge member 20*b* preferably contacts the peripheral edge of manway cover 4.

Turning now to FIG. 15A, there is illustrated another embodiment of the present invention showing a portable, manway hinge device 100. Manway hinge device 100 includes a pair of hinge plates 110, 120, a linkage member 130 and a pivot connection 150. Each hinge plate 110, 120 has a support member 112, 122 with a hinge aperture 114, 116, respectively. Hinge aperture 114, 116 are positioned for alignment with a bolt opening of a manway cover and manway flange. It should be noted that if the pre-existing bolt openings in the manway cover and manway flange are unsuitable for use with the present invention, additional bolt openings may be formed into the manway cover and manway flange that are suitable for use with the present invention. Linkage member 130 is adjacent a first hinge plate end 118, 128 of each hinge plate 110, 120 and extends out of the plane of each hinge plate 110, 120. Pivot connection 150 pivotally connects linkage member 130 of hinge plate 110 to linkage member 130 of hinge plate 120, which permits hinge plates 110, 120 to pivot relative to each other. Linkage member 130 may be a bent extension portion of hinge plate 120, integral to hinge plate 120 or a separate component that is welded or otherwise securely attached to hinge plate 120 using fasteners, compression studs, and the like, FIG. 15B is a front view of hinge device 100. This view clearly shows the spatial relationship of hinge plates 110, 120 and linkage members 130. As shown, linkage members 130 of hinge plate 110 are nested within linkage members 130 of plate 120. Alternatively, linkage members 130 may optionally be made for offset assembly where linkage member 130 of hinge plate 110 would be on the inside relative to the adjacent linkage member 130 of hinge plate 120 while the linkage member 130 at the opposite end of hinge plate 110 would be on the outside relative to the adjacent linkage member 130 of hinge plate 120.

Figure 16A:
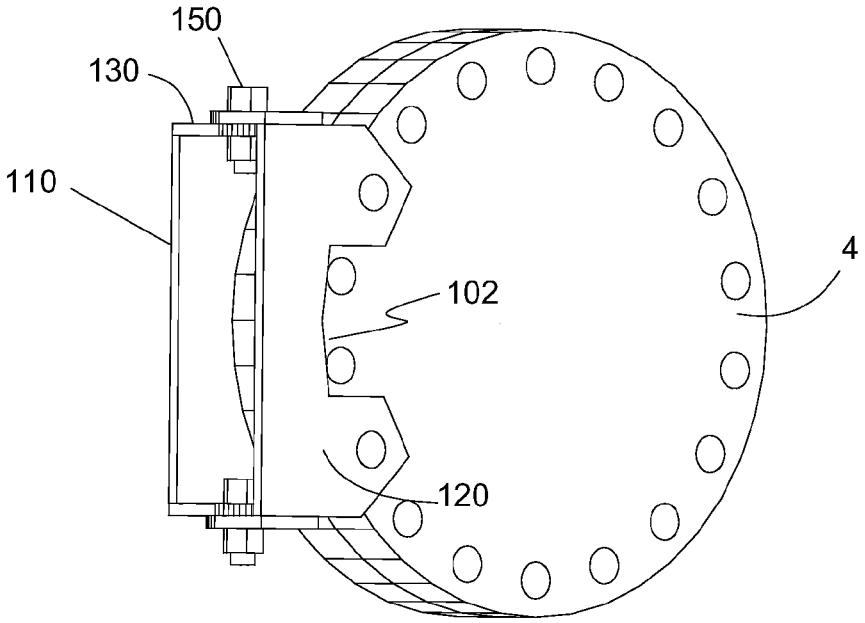
FIG. 16A is a perspective view of the embodiment in FIG. 15A showing the hinge device attached to the manway cover.
Figure 16B:
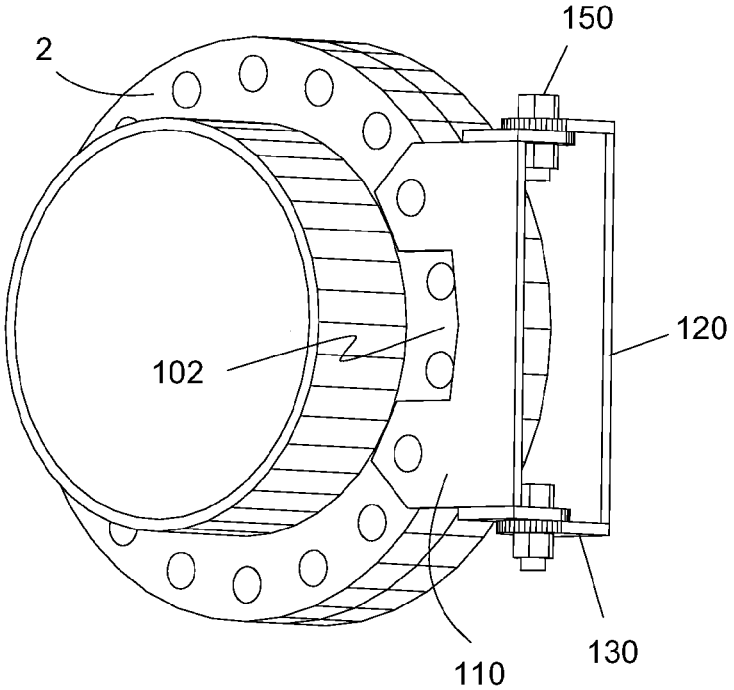
FIG. 16B is a perspective view of the embodiment in FIG. 15A showing the hinge device attached to the manway cover flange.
Figure 16C:
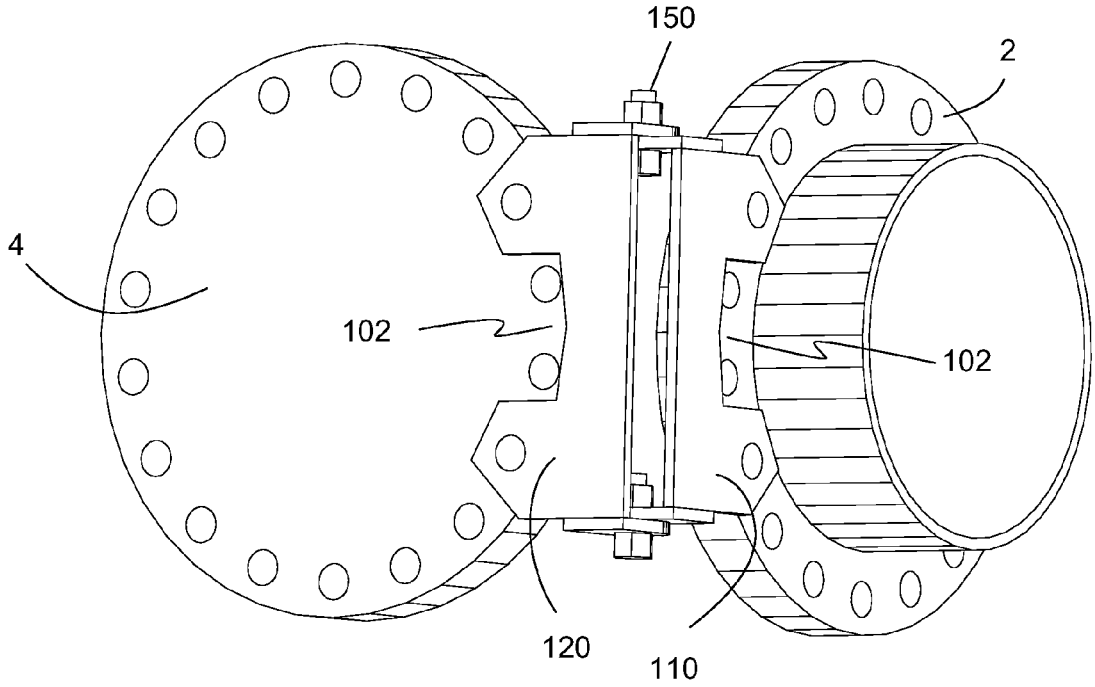
FIG. 16C is a perspective view of the embodiment in FIG. 15A showing the outside of the hinge device supporting a manway cover in an open position relative to the manway and manway flange.

FIGS. 16A, 16B and 16C illustrate hinge device 100 mounted on a manway cover 4 and a manway flange 2 in a closed and open position. FIG. 16A is a perspective cover view of hinge plate 120 attached to cover 4. FIG. 16B is a perspective flange view of hinge plate 110 attached to flange 2. FIG. 16C is an outside perspective view of hinge device 100 where cover 4 is in an open position relative to flange 2. Each of these figures shows an optional feature of hinge device 100. In this embodiment, an optional cutout or notch 102 provides access to cover bolts not originally removed for attaching hinge device 100 to cover 4 and flange 2. An alternative to a cutout or notch 102 is a plurality of apertures that are located in hinge plates 110, 120 that coincide with cover/flange bolts. It should be understood that the size of the plurality of apertures would be sufficiently large to allow access to the cover/flange bolts.

Figure 17A:
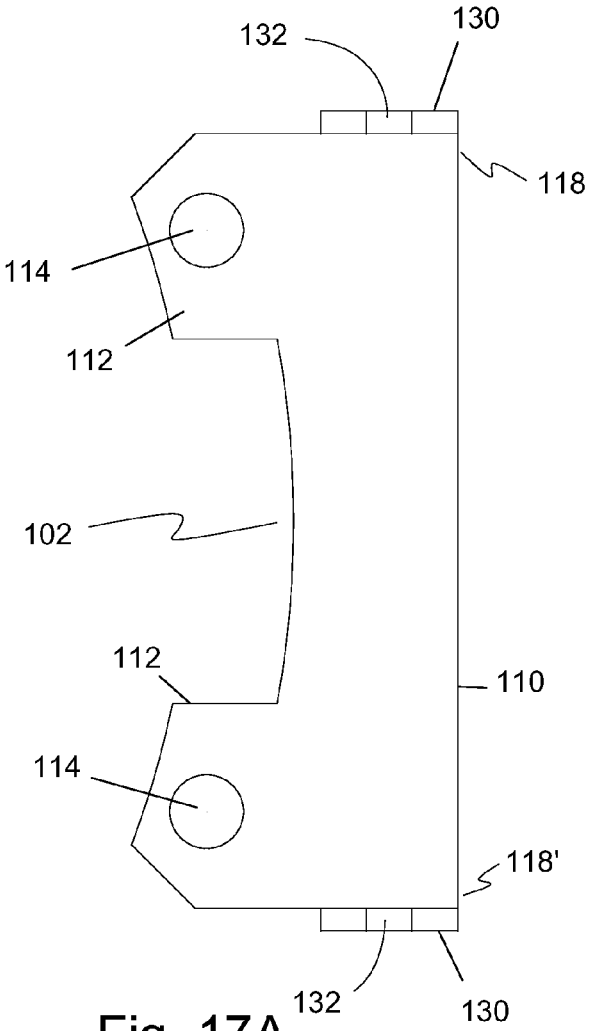
FIG. 17A is a side view of a hinge plate of the embodiment in FIG. 15A.
Figure 17C:
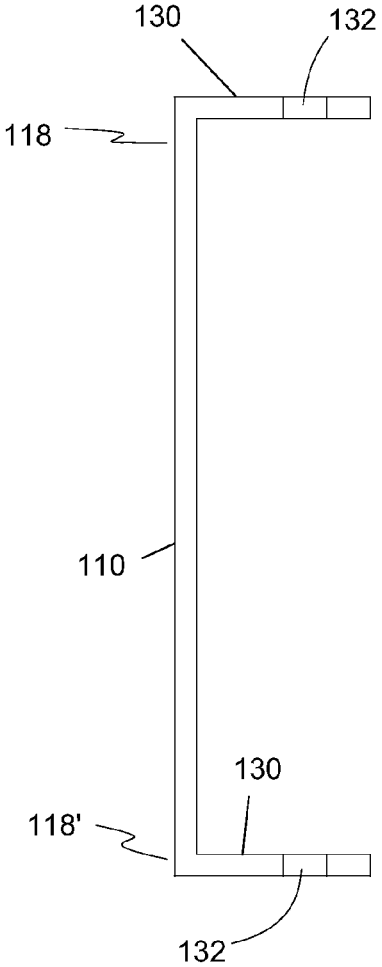
FIG. 17C is a rear view of the hinge plate in FIG. 15A.
Figure 17B:
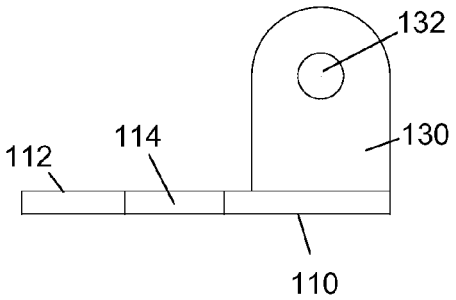
FIG. 17B is an end view of the hinge plate in FIG. 15A.

Turning now to FIG. 17A, there is illustrated a side view of a hinge plate 110 of the embodiment in FIG. 15A. Hinge plate 110 preferably includes a pair of linkage members 130 connected to first hinge plate end 118 and a second hinge plate end 118', a pair of support members 112 and a pair of hinge apertures 114 where each hinge aperture 114 is disposed in a corresponding support member 112. The optional notch 102 is located between the pair of support members 112. FIG. 17B is an end view of hinge plate 110 showing the linkage member 130. Linkage member 130 preferably has a linkage aperture 132 for receiving a linkage pin (not shown). FIG. 17C is a rear view of hinge plate 110. Each linkage member 130 extends away from the plane of hinge plate 110 in the same direction for a predefined distance. The length is typically sufficient to provide a pivot point spaced from the peripheral edge of the cover and cover flange that allows the cover to which hinge plate 110 is attached to pivot away from the cover flange.

Turning now to FIG. 18A, there is illustrated another embodiment of hinge plate 110. Hinge plate 110 includes all of the features previously discussed including the pair of linkage members 130, support members 112 and hinge apertures 114. Additionally, hinge plate 110 includes an optional inside plate stiffener 170. Inside plate stiffener 170 is a reinforcing component that is attached to hinge plate 110 and extends between linkage members 130. Inside plate stiffener 170 provides reinforcement support to both the hinge plate 110 and the linkage members 130. FIG. 18B shows an end view of hinge plate 110. Preferably, each linkage member 130 has a linkage aperture 132 for receiving a pivot pin (not shown) for connecting an overlapping linkage member 130 of hinge plate 110 with a corresponding linkage member 130 of hinge plate 120. Although inside plate stiffener 170 is shown as being positioned to the inside edge of linkage member 130, other placement alternatives between linkage members 130 are also possible and within the skill of one of ordinary skill in the art. FIG. 18C shows a rear view of hinge plate 110 and inside plate stiffener 118. Like the linkage members 130, inside plate stiffener 170 preferably extends out of the plane of hinge plate 110. The distance that inside plate stiffener 170 extends away from hinge plate 110 is illustrative only and it should be noted that inside plate stiffener 170 could extend the length of linkage members 130 or any length in between.

Figure 19:
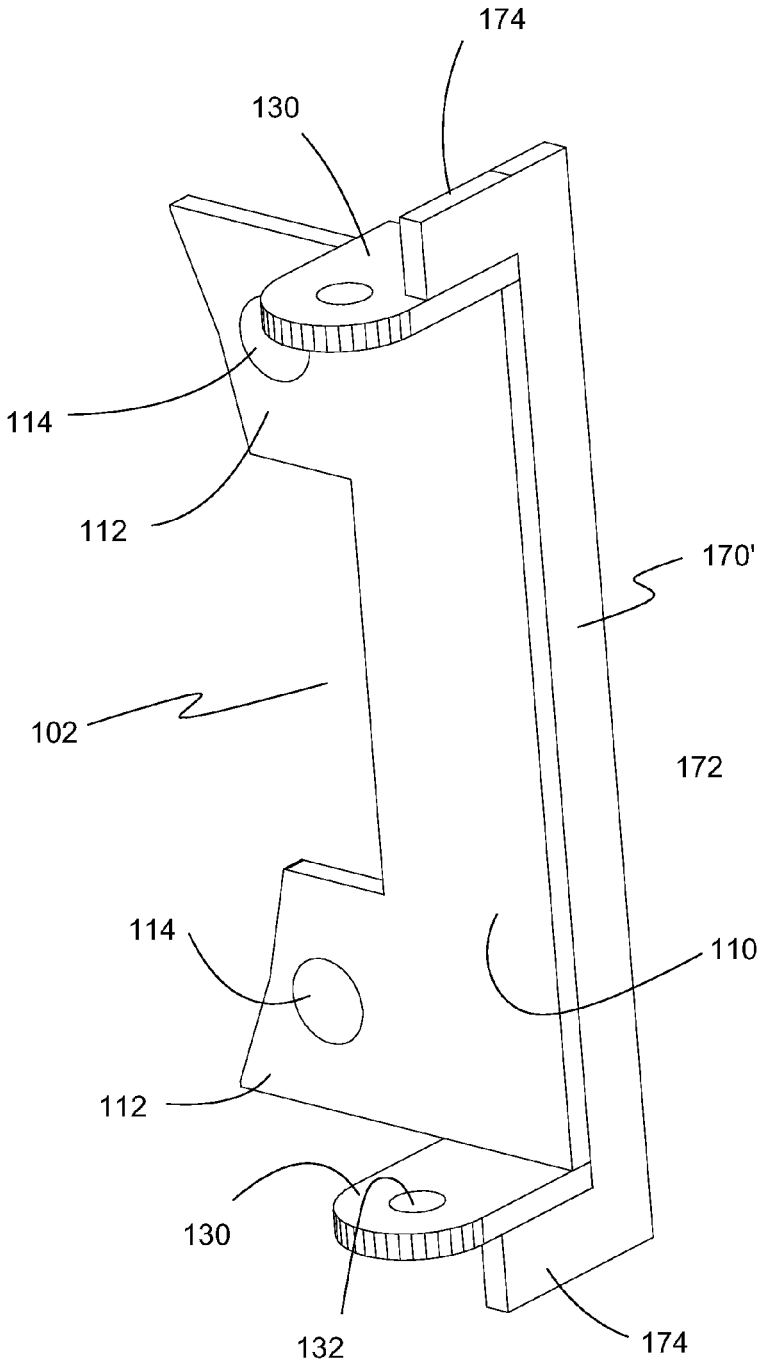
FIG. 19 is a perspective view of the hinge plate of the embodiment in FIG. 15A showing an external plate stiffener.

FIG. 19 illustrates hinge plate 110 with an outside plate stiffener 170'. Hinge plate 110 includes the support member 112 with hinge plate aperture 114 and linkage member 130. Outside plate stiffener 170' has a stiffener plate portion 172 that extends out of the plane of hinge plate 110 in an opposite direction as linkage member 130 and a stiffener linkage portion 174 that extends over linkage member 130. It should be understood that the illustrated position of outside plate stiffener 170' is not limiting. Outside plate stiffener 170' may be positioned such that stiffener linkage portion 174 extends over any area of linkage member 130 so long as outside plate stiffener 170' does not interfere with the pivot connection of hinge plate 110.

Figure 20:
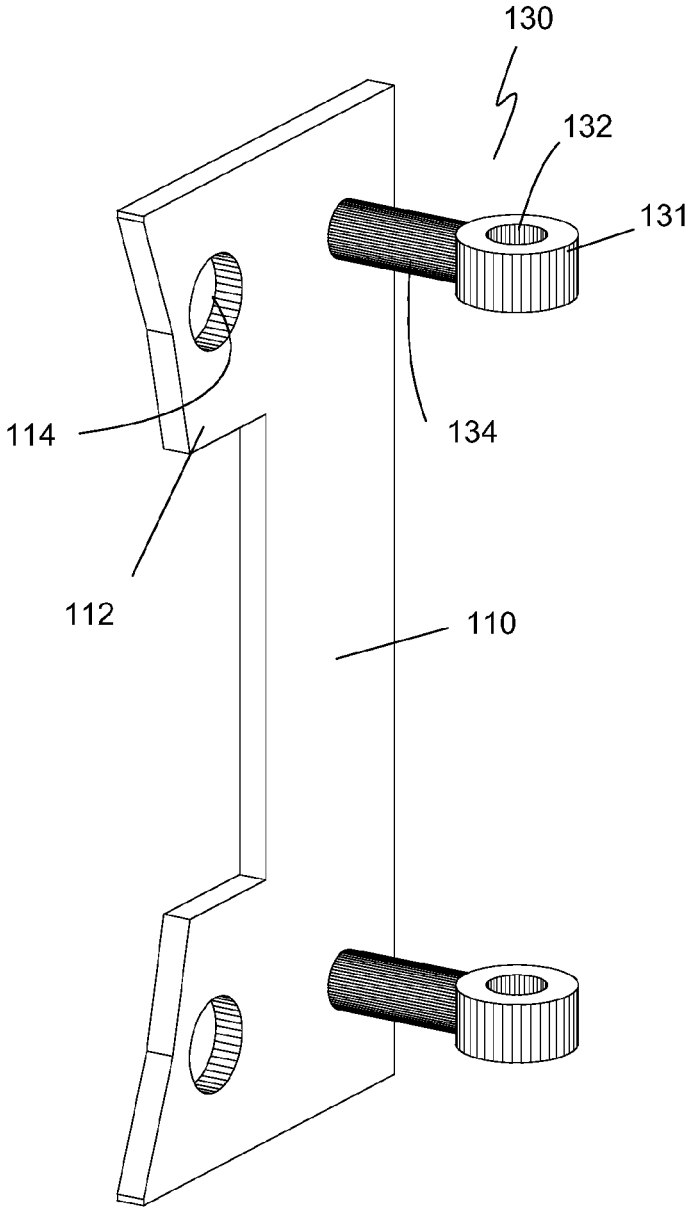
FIG. 20 is a perspective view of another embodiment of the linkage member of the hinge device of the present invention.

Turning now to FIG. 20, there is illustrated hinge plate 110 with an alternative embodiment of linkage member 130. Linkage member 130 includes a linkage spacer portion 134 and a linkage pivot portion 131. Linkage pivot portion 131 contains linkage aperture 132.

Figure 21:
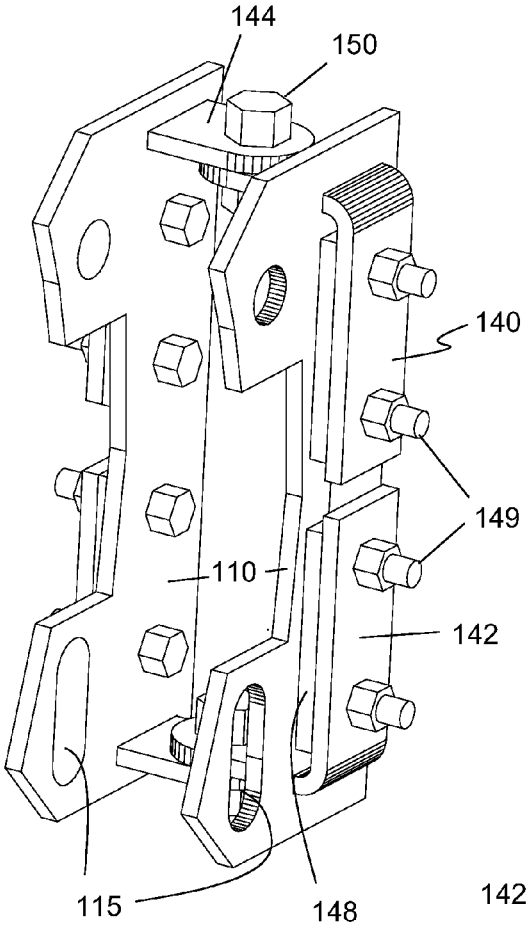
FIG. 21 is a perspective view of another embodiment of the present invention showing a hinge device with adjustable linkage members.

FIG. 21 illustrates a perspective view of another embodiment of hinge device 100. In this embodiment, hinge plates 110, 120 include an adjustable linkage member 140. Adjustable linkage member 140 includes a linkage member body 142 and a linkage member tab 144. An optional linkage member spacer 148 is also provided. Linkage member tab 144 is configured for receiving pivot connection 150. Linkage member spacer 148 is optionally positioned between hinge plate 110, 120 and linkage member body 142. Linkage member spacer 148 may be provided in a variety of thicknesses for adjusting the hinge pivot point based on the thickness of the cover and the cover flange. Also shown is optional hinge adjustment slot 115.

Figure 22:
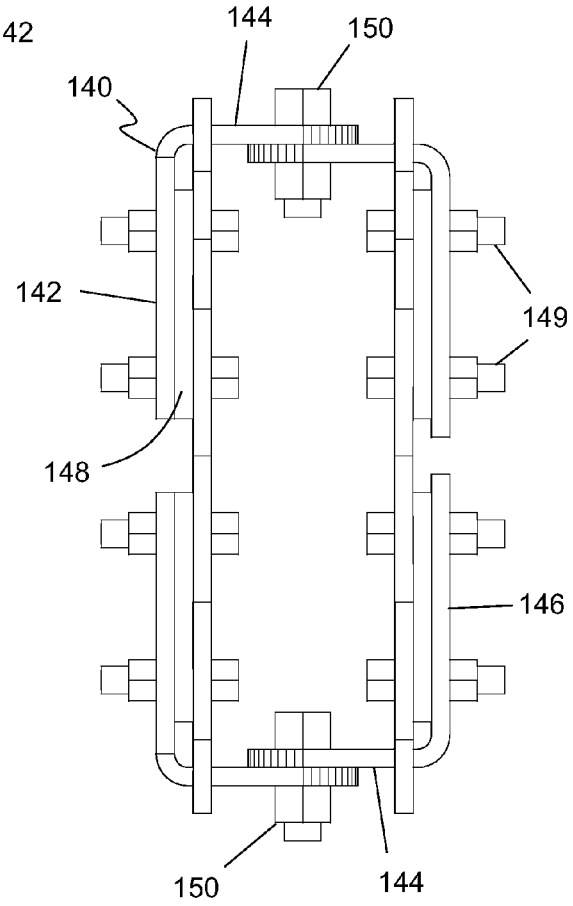
FIG. 22 is a front view of the embodiment shown in FIG. 21.

FIG. 22 is a front view of the embodiment of hinge device 100. As illustrated, a plurality of hinge tab fasteners 149 secures adjustable linkage member 140 and optional linkage member spacer 148 to hinge plates 110, 120. It should be recognized that the non-use of linkage member spacer 148 or the use of a linkage member spacer 148 having different thicknesses provides adjustment of the spatial position of pivot connection 150 relative to hinge plates 110, 120. This adjustment capability allows modification to hinge device 100 for covers and cover flanges of different thicknesses. It is noted that only one hinge plate may have the adjustable linkage member 140 while the other hinge plate has a fixed linkage member 130.

Figure 23:
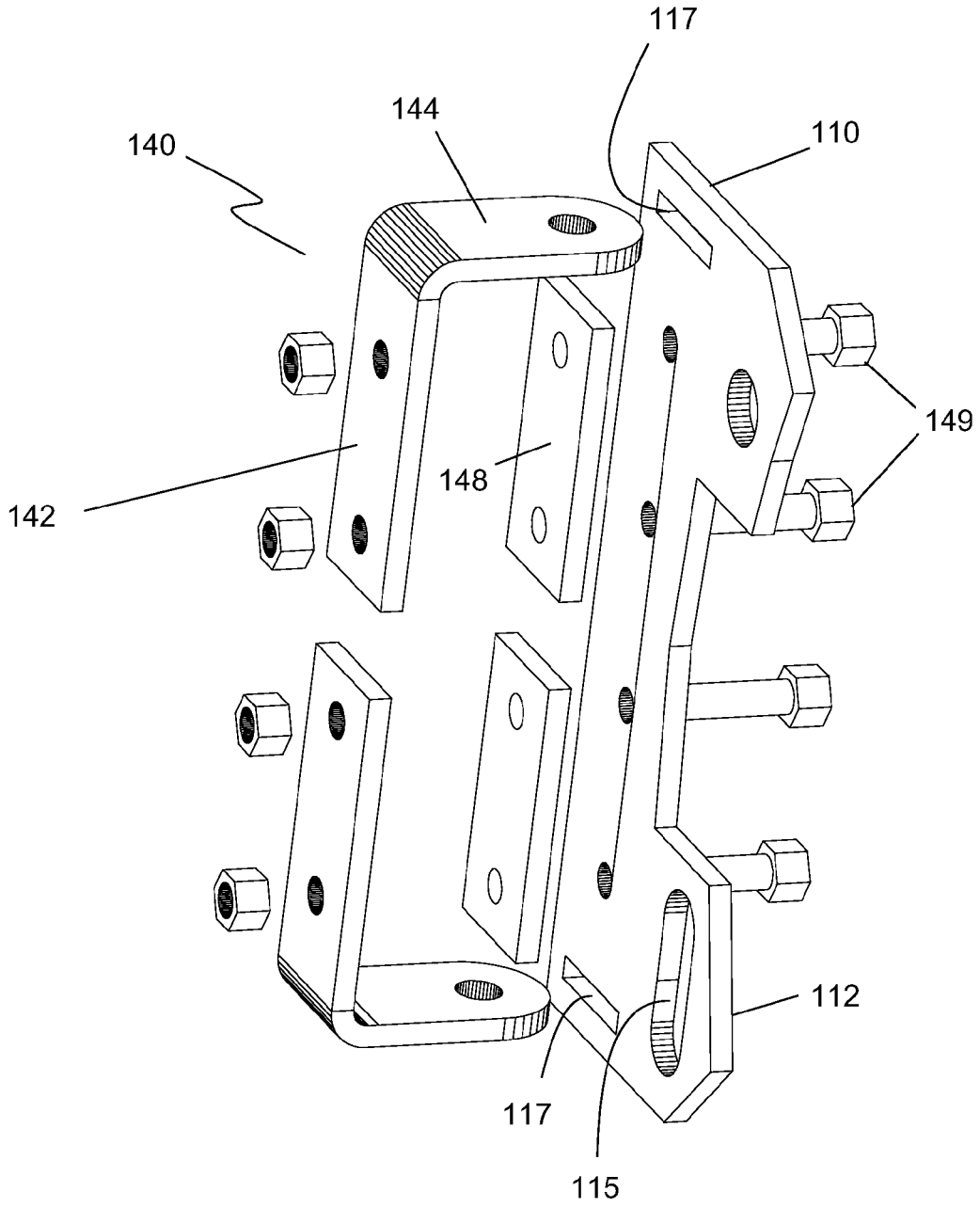
FIG. 23 is an exploded, perspective view of one half of the hinge device shown in FIG. 21.

Turning now to FIG. 23, there is illustrated and exploded view of hinge device 100 illustrated in FIGS. 21 and 22. As is more clearly shown, hinge plate 110 includes a linkage member slot 117. Linkage member slot 117 receives linkage member tab 142, which extends out of the plane of hinge plate 110. Optional linkage member spacer 148 provides a means for adjusting the distance that linkage member tab 142 extends away from hinge plate 110 and, thus, the relative position of pivot connection 150. If optional linkage member spacer 148 is not used, the relative position of pivot connection 150 is spaced further from hinge plate 110. When optional linkage member spacer 148 is used, the closer the relative position of pivot connection 150 is to hinge plate 110. The distance between pivot connection 150 and hinge plate 110 is determined by the thickness of linkage member spacer 148. It is preferable to use bolts as the plurality of hinge tab fasteners 149 for connecting adjustable linkage member 140 to hinge plate 110. In this embodiment, there is also illustrated an optional hinge adjustment slot 115 in hinge support 112 instead of the hinge aperture 114. Since the spacing between the holes in covers vary by both flange diameter and the number of bolt holes around the circumference of the flange, optional hinge adjustment slot 115 is provided to adjustability for multiple flange geometries.

Figure 24:
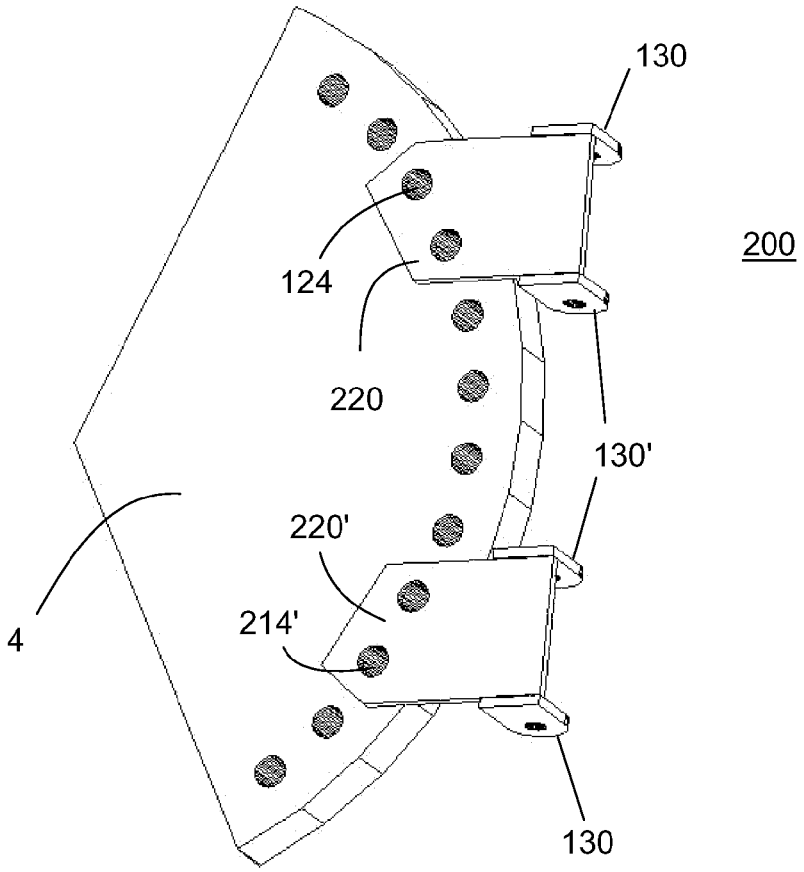
FIG. 24 is a perspective view of another embodiment of the present invention showing a split hinge device.

In situations where a relatively large cover is to be removed or a split cover is anticipated, a split hinge embodiment is contemplated. FIG. 24 illustrates one embodiment of a split hinge device 200 on a cover 4. Split hinge device 200 includes an upper hinge plate 220 and a lower hinge plate 220'. Upper hinge plate 220 and lower hinge plate 220' include a linkage member 130 and a hinge plate aperture 124. Upper hinge plate 220 and lower hinge plate 220' may optionally include a second linkage member 130'. Although only the cover hinge plates 220, 220' are illustrated, it is understood that the cover flange 2 would also have corresponding flange hinge plates with pivot connections connecting the flange hinge plates to the cover hinge plates.

In all of the embodiments of the present invention, pin 60 can be a bolt or pin. For example, pin 60 may be the existing studs or bolts from the manway cover 4 and manway cover flange 2, a close fit pin, a special bolt/pin with an interference fit at the flange hole and the cover hole, a bolt with threads configured to attach to a threaded pin receiving end 42 of support member 40, a tapered pin, an expandable plug, a bolt/pin that is eccentric or concentric to the flange hole and the cover hole and could be a loose or tight fit to the hole, or the cover hole could be threaded to receive a bolt.

Figure 26:
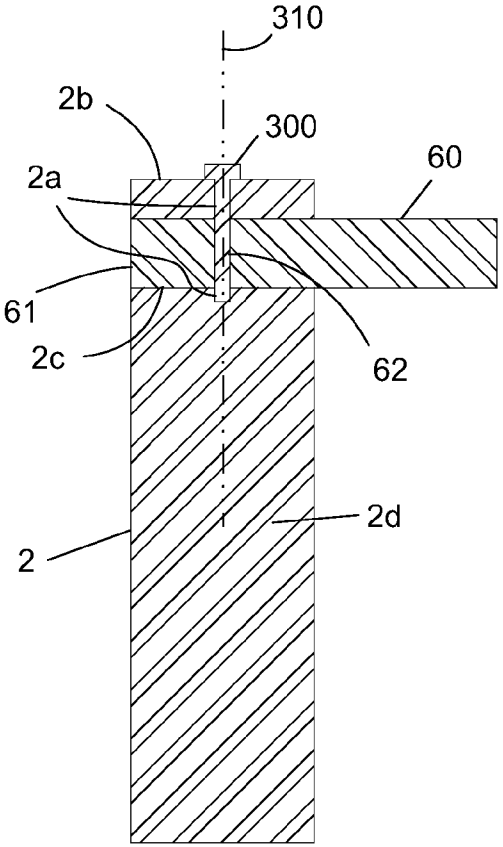
FIG. 26 is a cross-sectional view of the embodiment in FIG. 25 showing the hinge pin in the manway cover opening with a transverse rod through the circular manway flange an into the hinge pin.
Figure 25:
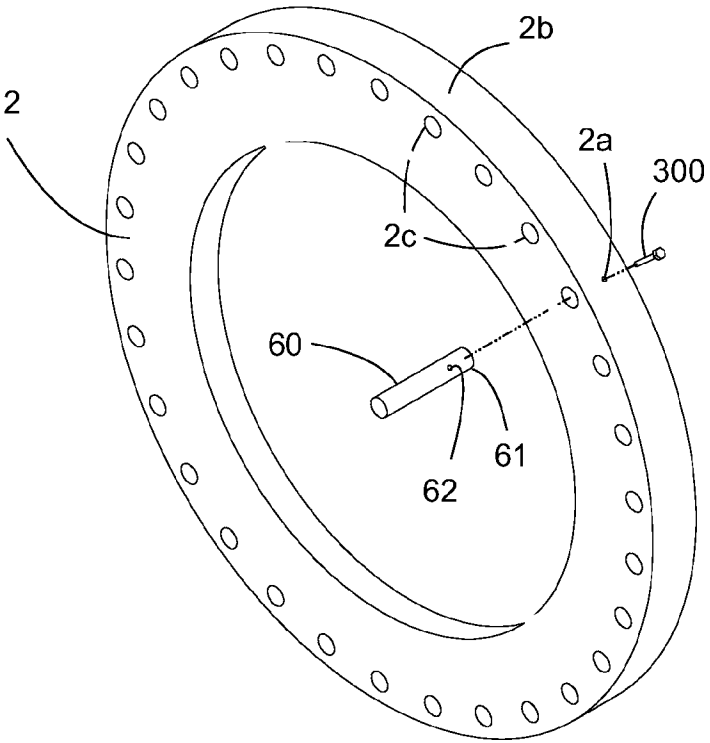
FIG. 25 is a perspective, exploded view of another embodiment of the present invention showing a hinge pin, a transverse rod and a circular manway flange.

Turning now to FIG. 25, there is illustrated an exploded, perspective view of a circular manway flange 2, a pin 60 and a transverse rod 300. For clarity, flange hinge plate 110 is not shown. Pin 60 has a pin first end 61 with a transverse bore 62 through pin first end 61. Manway flange 2 has a flange bore **2*a* that is transverse to the perimeter 2*b*. Flange bore 2*a* is positioned on perimeter 2*b* so that flange bore 2*a* penetrates into a bolt opening 2*c* of manway flange 2. Optionally, flange bore 2*a* may extend from perimeter 2*b* into bolt opening 2*c*, transect bolt opening 2*c* and into the opposite surface of bolt opening 2*c* for a predefined distance into the inner portion 2*d* of flange 2 along the same longitudinal axis 310 of flange bore 2*a*. FIG. 26 illustrates a cross-sectional view of an assembly of the components shown in FIG. 25. As illustrated, bolt opening 2*c* of manway flange 2 receives pin 60 and transverse rod 300 is positioned in flange bore 2*a* through transverse bore 62 of pin first end 61. In this embodiment, it can be seen that flange bore 2*a* continues into inner portion 2*d* and that transverse rod 300 extends into inner portion 2*d*. If transverse rod 300 only extends into pin first end 61, it is described as being in single shear. If transverse rod 300 extends completely through pin first end 61 and into inner portion 2*d***, it is described as being in double shear.

Figure 28:
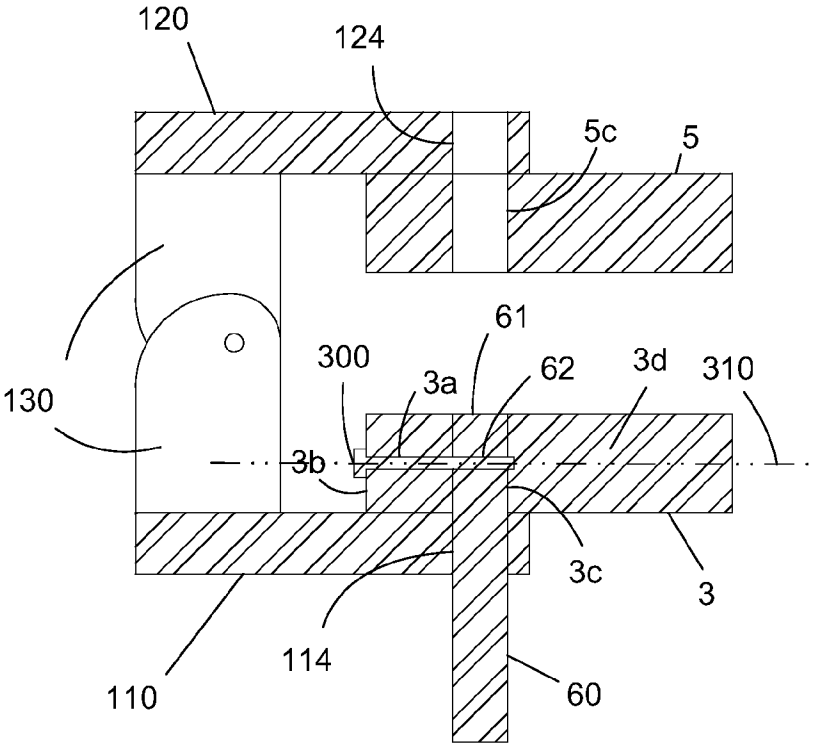
FIG. 28 is a cross-sectional view of the embodiment in FIG. 25 showing the hinge pin in the manway cover opening with a transverse rod through the rectangular or square manway flange an into the hinge pin.
Figure 27:
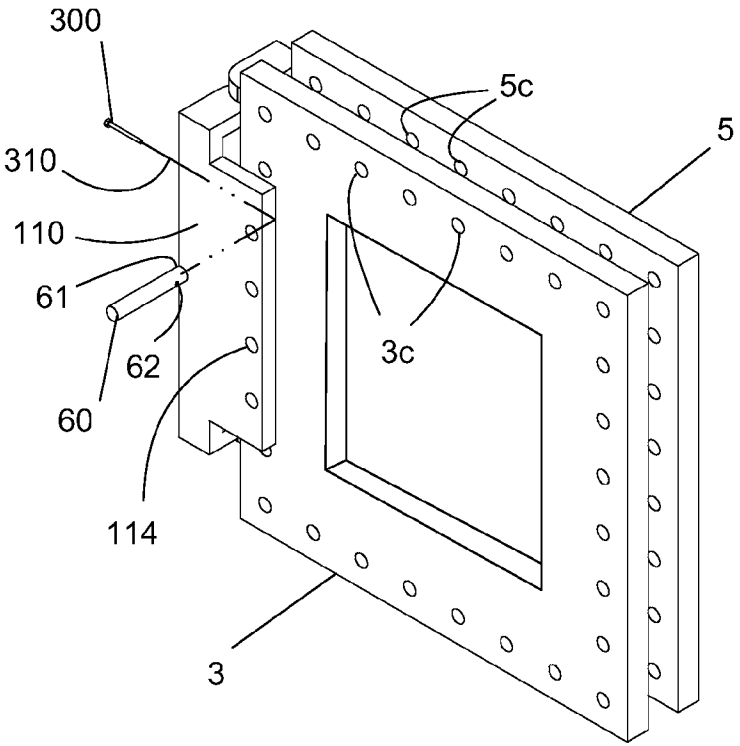
FIG. 27 is a perspective, exploded view of another embodiment of the present invention showing a hinge pin, a transverse rod and a rectangular or square manway flange.

FIG. 27 is an exploded, perspective view of a rectangular/square manway flange 3, a rectangular/square manway cover 5, a pin 60 and a transverse rod 300. Pin 60 has a pin first end 61 with a transverse bore 62 through pin first end 61. Manway flange 3 has a flange bore **3*a* that is transverse to the perimeter 3*b*. Flange bore 3*a* is positioned on perimeter 3*b* so that flange bore 3*a* penetrates into a bolt opening 3*c* of manway flange 3. Optionally, flange bore 3*a* may extend from perimeter 3*b* into bolt opening 3*c*, transect bolt opening 3*c* and into the opposite surface of bolt opening 3*c* for a predefined distance into the inner portion 3*d* of flange 3 along the same longitudinal axis 310 of flange bore 3*a*. Flange hinge plate 110 is shown having a plurality of pin receiving openings 114 positioned for alignment with bolt openings 3*c* for receiving pin 60 therethrough. FIG. 28 illustrates a cross-sectional view of an assembly of the components shown in FIG. 27, including flange hinge plate 110 to manway flange 3, flange cover plate 120 to manway cover 5 and nesting and overlapping hinge flanges 130 for pivotally connecting flange hinge plate 110 to flange cover plate 120. As illustrated, bolt opening 3***c* of manway flange 3 and pin receiving opening 114 of flange hinge plate 110 receives pin 60 and transverse rod 300 is positioned in flange bore 3*a* through transverse bore 62 of pin first end 61. In this embodiment, it can be seen that flange bore 3*a* continues into inner portion 3*d* and that transverse rod 300 extends into inner portion 3*d*. If transverse rod 300 only extends into pin first end 61, it is described as being in single shear. If transverse rod 300 extends completely through pin first end 61 and into inner portion 3*d*, it is described as being in double shear.

Figure 30:
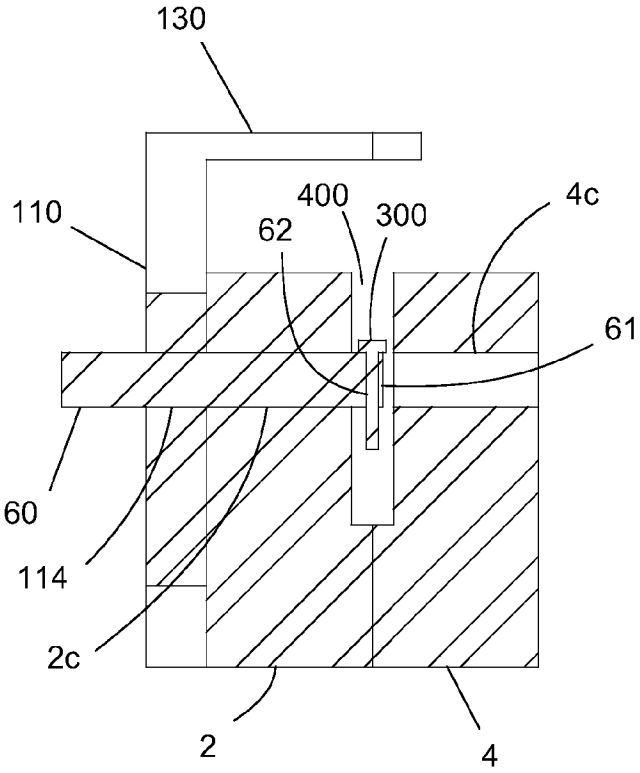
FIG. 30 is a cross-sectional view of the embodiment in FIG. 29 showing the hinge pin in the manway cover opening with a transverse rod in the recessed portion and into the hinge pin.
Figure 29:
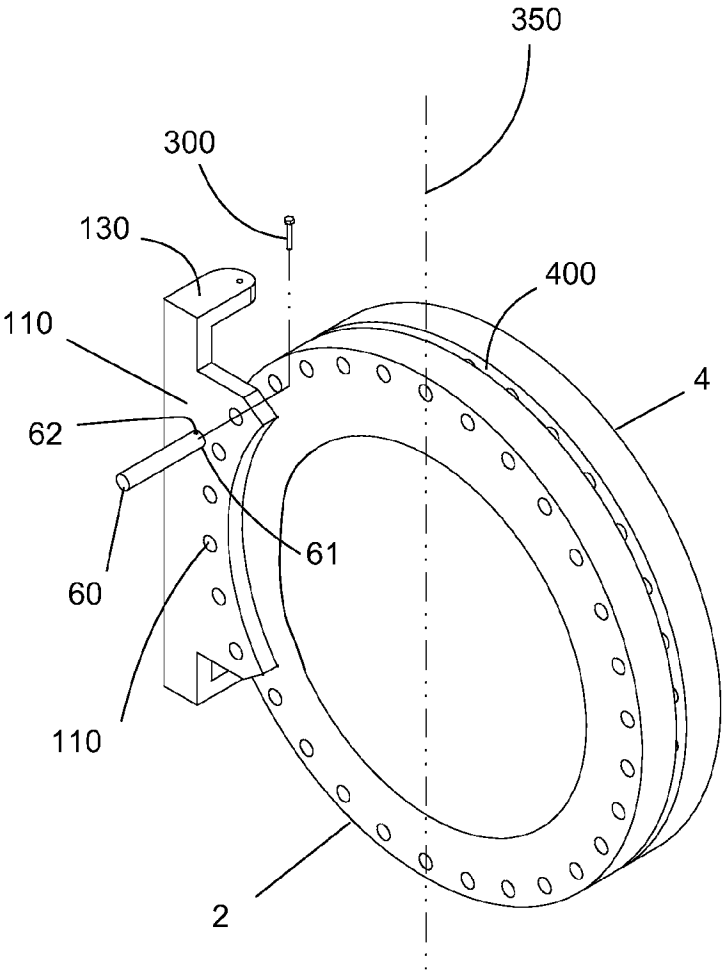
FIG. 29 is a perspective, exploded view of another embodiment of the present invention showing a hinge pin, a transverse rod and a circular manway flange and cover having a recessed portion around the periphery between the flange and the cover.

FIG. 29 illustrates another embodiment of the present invention that uses pin 60 with transverse rod 300. In this exploded view embodiment, there is a flange-cover space 400 between circular manway flange 2 and circular manway cover 4 along the perimeter to a depth beyond the bolt openings 2*c*, 3*c*. As illustrated, flange hinge plate 110 is positioned to one side of a vertical axis 350 of manway flange 2 so that the hinge plate opening 114 that is to receive pin 60 is aligned with manway flange bolt opening 2*c* (not shown). Pin 60 has a transverse bore 62 through pin first end 61. FIG. 30 illustrates a cross-sectional view of the assembled components shown in FIG. 29. As illustrated, bolt opening 2*c* of manway flange 2 and pin receiving opening 114 of flange hinge plate 110 receives pin 60 and pin first end 61 extends into flange-cover space 400. Transverse rod 300 is positioned through transverse bore 62 of pin first end 61 within flange-cover space 400.

Figure 32:
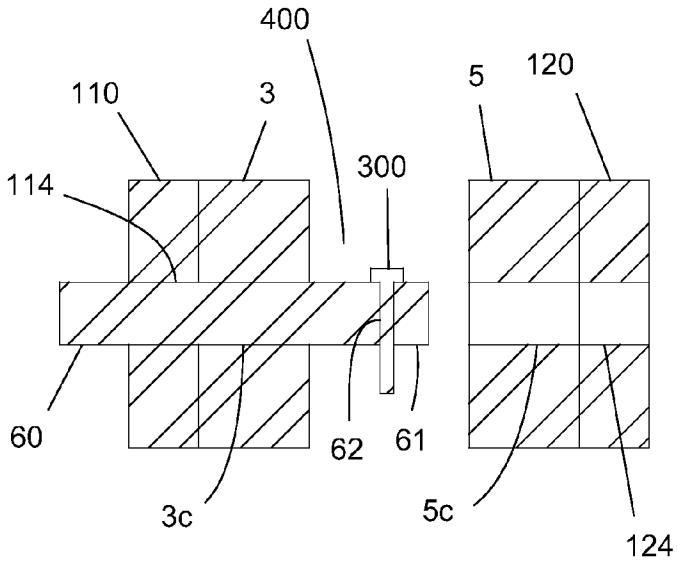
FIG. 32 is a cross-sectional view of the embodiment in FIG. 29 showing the hinge pin in the manway cover opening with a transverse rod in the recessed portion and into the hinge pin.
Figure 31:
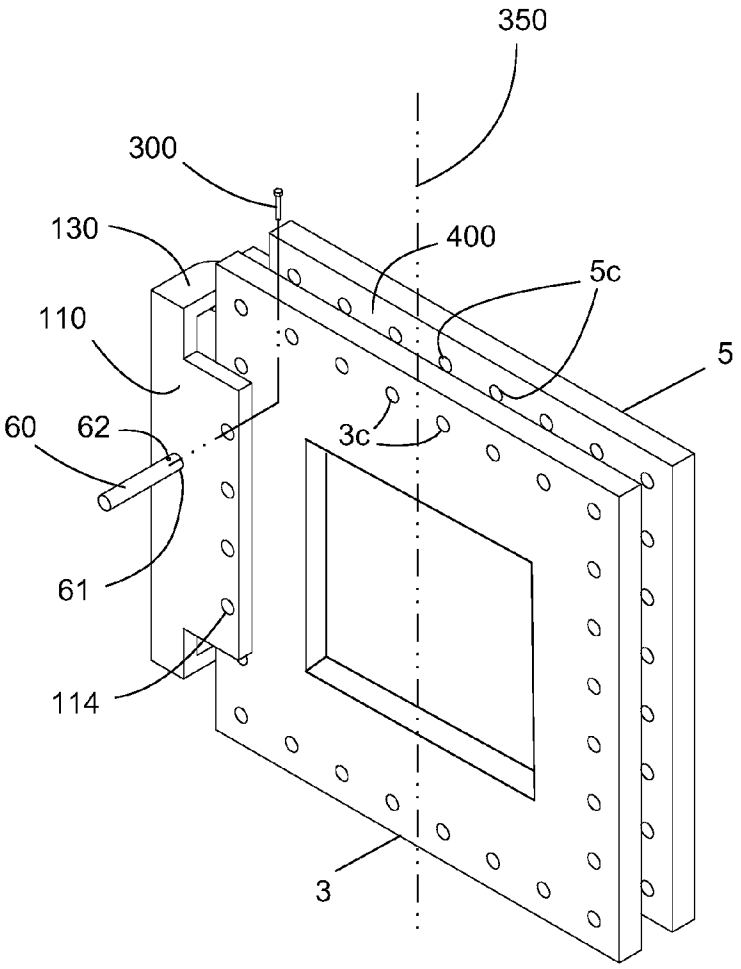
FIG. 31 is a perspective, exploded view of another embodiment of the present invention showing a hinge pin, a transverse rod and a rectangular or square manway flange and cover having a recessed portion around the periphery between the flange and the cover.

FIG. 31 is an exploded, perspective view of a rectangular/square manway flange 3, a rectangular/square manway cover 5, a pin 60 and a transverse rod 300. Like the embodiment shown in FIG. 29, there is a flange-cover space 400 between rectangular/square manway flange 3 and rectangular/square manway cover 5 along the perimeter to a depth beyond the bolt openings 3*c*, 5*c*. Pin 60 has a pin first end 61 with a transverse bore 62 through pin first end 61. As illustrated, flange hinge plate 110 is positioned to one side of a vertical axis 350 of manway flange 3 so that the hinge plate opening 114 that is to receive pin 60 is aligned with manway flange bolt opening 3*c* (not shown). FIG. 32 illustrates a cross-sectional view of the assembled components shown in FIG. 31. As illustrated, bolt opening 3*c* of manway flange 3 and pin receiving opening 114 of flange hinge plate 110 receive pin 60 so that pin first end 61 extends into flange-cover space 400. Transverse rod 300 is positioned through transverse bore 62 of pin first end 61 within flange-cover space 400.

Figure 33:
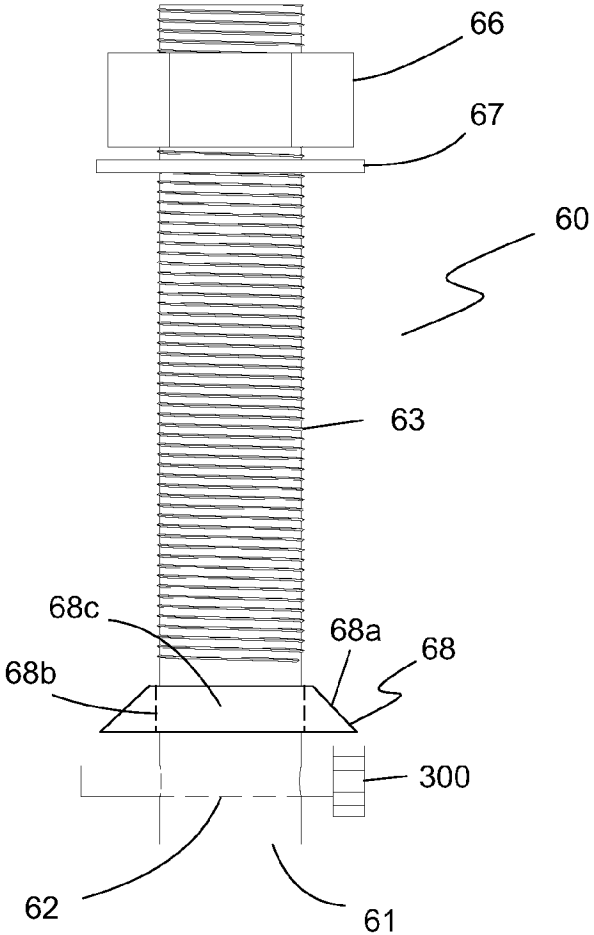
FIG. 33 is a side view of one embodiment of a hinge pin with a transverse rod.

Turning now to FIG. 33, there is illustrated one embodiment of a pin 60. Pin 60 is a threaded rod having a pin first end 61 with a transverse bore 62. Within transverse bore 62 is a removable transverse rod 300. A tightening nut 66 and an optional washer 67 is threadably connected to the threaded portion 63 of pin 60, which is used to secure hinge plates 110, 120 to manway flange 2 and manway cover 4, respectively. An optional centering component 68 may be included with pin 60. Centering component 68 has a component body 68*a*, an opening 68*b*, and a conically-shaped tapered surface 68*c*. Centering component 68 is disposed onto pin 60 adjacent pin first end 61 between transverse rod 300 and tightening nut 66 so that tapered surface 68*c* buts against the peripheral edge of a bolt opening to center pin 60 within the bolt opening. Opening 68*b* may optionally be threaded especially if pin 60 includes a threaded portion 63 that extends the entire length of pin 60 to pin first end 61. It should be understood that pin 60 may optionally use tapered nuts at both ends of pin 60 for centering pin 60 within the bolt openings in flange hinge plates 110, 120, manway flange 2 and manway cover 4.

Figure 34:
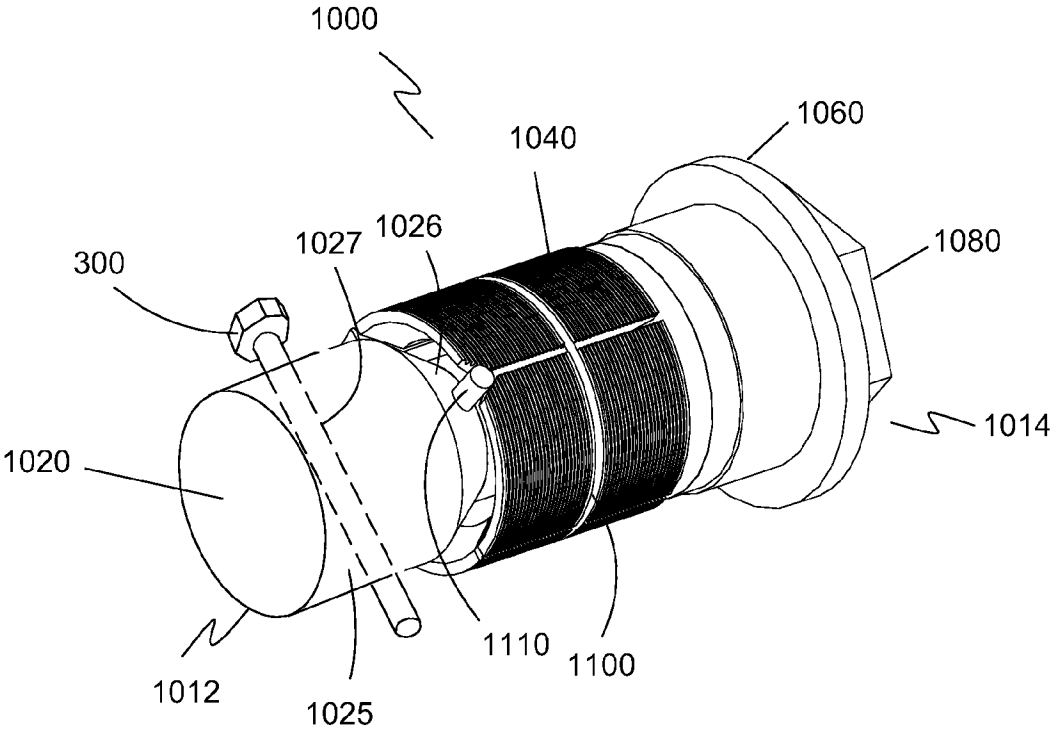
FIG. 34 is a side view of one embodiment of an expandable pin with a transverse rod.

FIG. 34 illustrates a modified expanded pin 60 that is more fully described in PCT patent application Ser. No. PCT/US2009/052,833, which is incorporated herein by reference. In this embodiment, pin 60 is a pull-up bolt assembly 1000 that includes a pull-up bolt member 1020, a radially expandable friction member 1040, a tapered member 1060, and a nut component 1080. In this embodiment, a retaining ring 1100 is disposed around the friction member 1040 and an optional anti-rotation member 1110 laterally extends from pull-up bolt member 1020 and cooperates with expandable friction member 1040. Pull-up bolt assembly 1000 has a blind end 1012 and a torque-applying end 1014. Optional anti-rotation member 1110 is configured to prevent the expandable friction member 1040 from rotating around pull-up bolt member 1020. Pull-up bolt member 1020 includes an abutting member 1025 with a tapered surface 1026. Abutting member 1025 has a transverse bore 1027 that receives transverse rod 300.

Figure 36:
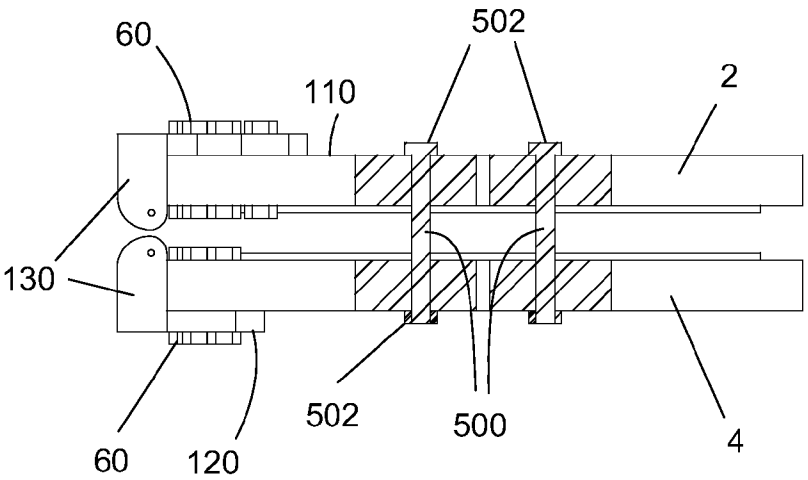
FIG. 36 is a top, cross-sectional view of the extended length cover supporting rod shown in FIG. 35.
Figure 35:
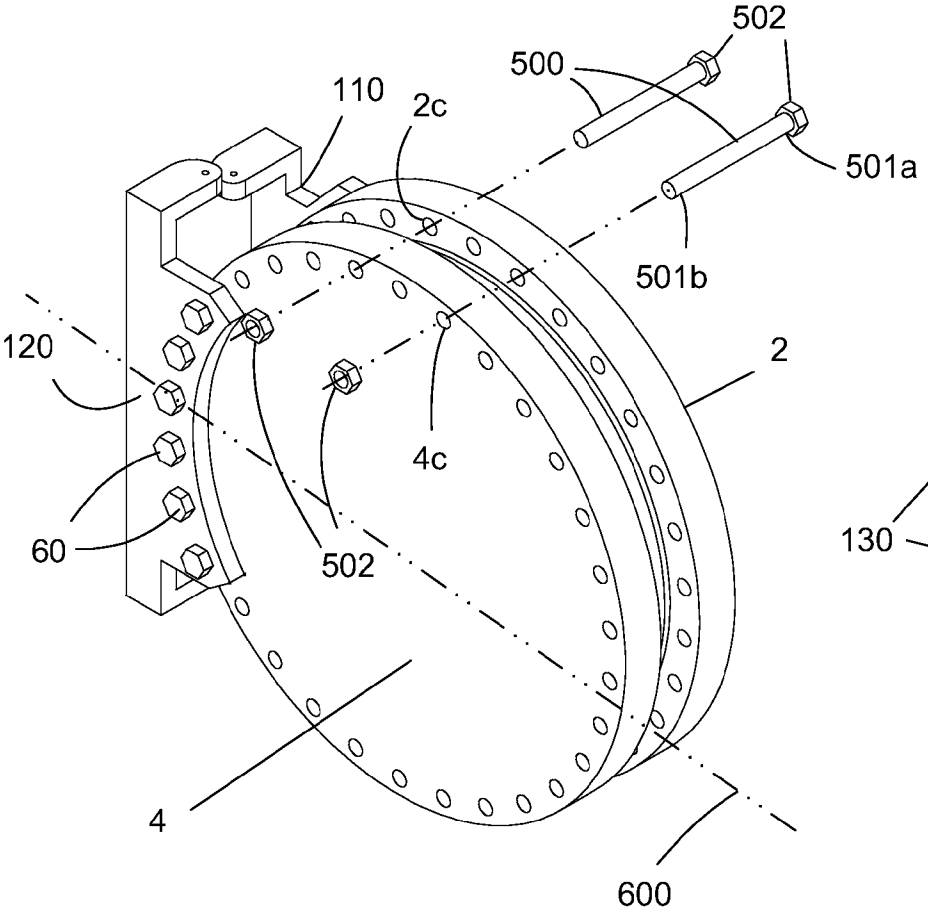
FIG. 35 is a front view of one embodiment of the extended length cover supporting rod of the present invention in at least one of the upper manway cover bolt openings above the horizontal axis of a circular manway cover.

FIG. 35 illustrates another embodiment of the present invention showing an exploded, perspective view of a circular manway flange 2, a circular manway cover 4, a flange hinge plate 110, a cover hinge plate 120, and at least one extended length cover supporting rod 500. Cover supporting rod 500 extends through a flange bolt opening 2*c* and a corresponding cover bolt opening 4*c* located in manway cover 4. It is preferable that the bolt opening 4*c* is in an upper portion of manway cover 4 that is above the horizontal axis 600 of manway cover 4. Cover supporting rod 500 includes optional but preferred end stops 502 at each end 501*a*, 501*b*. FIG. 36 is a cross-sectional view of a pair of extended length cover supporting rods 500 connected to cover 4 and flange 2. Cover supporting rod 500 is used to support manway cover 4 after all of the remaining cover bolts are removed. Once all of the remaining cover bolts are removed, manway cover 4 is separated from manway flange 2 a predefined distance for the purpose of attaching cover hinge plate 120 and flange hinge plate 110 to cover 4 and flange 2, respectively. By being able to support cover 4 while separating it from flange 2, cover supporting rod 500 allows the use of a pin 60 that has a transverse rod 300, a nut 66, a centering component 68, or a combination of similar fasteners and/or end stops that can be positioned at the inside surfaces (i.e. the opposing surfaces) of cover 4 and flange 2. As can be seen in FIG. 36, cover 4 is separated from flange 2 and is supported by extended length cover supporting rods 500. Pins 60 extend through cover hinge plate 120 and flange hinge plate 110 securing cover hinge plate 120 and flange hinge plate 110 to cover 4 and flange 2, respectively. After securing the hinge plates 110, 120, cover 4 is moved toward flange 2 to permit rotatable connection of hinge plates 110, 120 to each other at hinge flanges 130. Cover supporting rod 500 may be rods, bolts, studs, pins, tubing, and the like that are sized to fit through the cover and flange bolt openings but strong enough to support the weight of the cover and permit sliding of the cover away or toward the flange. Although the use of a single cover supporting rod 500 is contemplated, it is preferable to use two or more supporting rods 500.

Cover supporting rod 500 has a diameter that is smaller than the diameter of the existing bolt openings 2*c*, 4*c* in flange 2 and cover 4, respectively. Preferably, the difference in diameter is one-sixteenth of an inch or less. By maintaining a relatively close fit of the cover supporting rod 500 to the existing bolt openings 2*c*, 4*c*, the amount of sag or drop the cover 4 will experience will be minimized. Cover supporting rod 500 also preferably has threads on each end only as far as needed for the predefined distance of separation required to achieve the intended purpose, i.e. attachment of a hinge device 100 or only to separate the cover from the flange for removal using other techniques. The end stops 502 are nuts that are threaded onto the ends of cover supporting rod 500. Nuts with a tapered side similar to lug nuts used on a vehicle wheel may also be used. The tapered nuts will center the cover support rod 500 in the existing bolt openings 2*c*, 4*c*.

Figure 38:
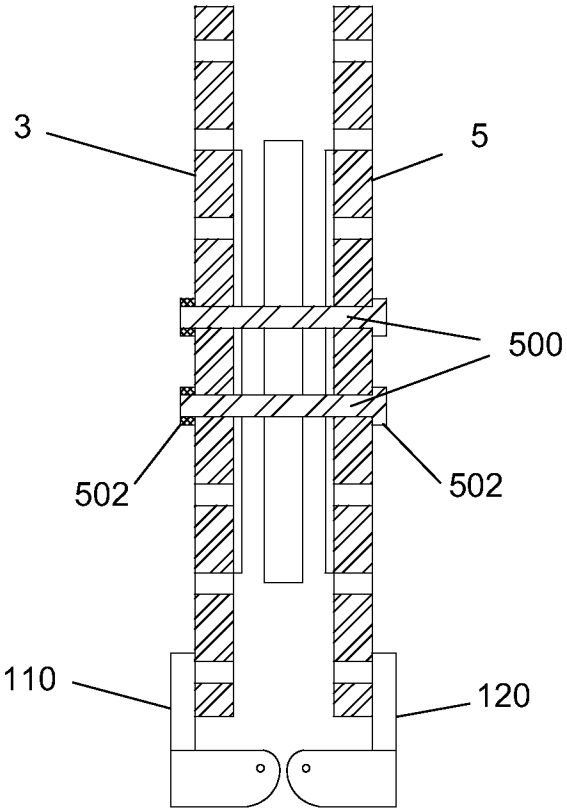
FIG. 38 is a top, cross-sectional view of the extended length cover supporting rod shown in FIG. 37.
Figure 37:
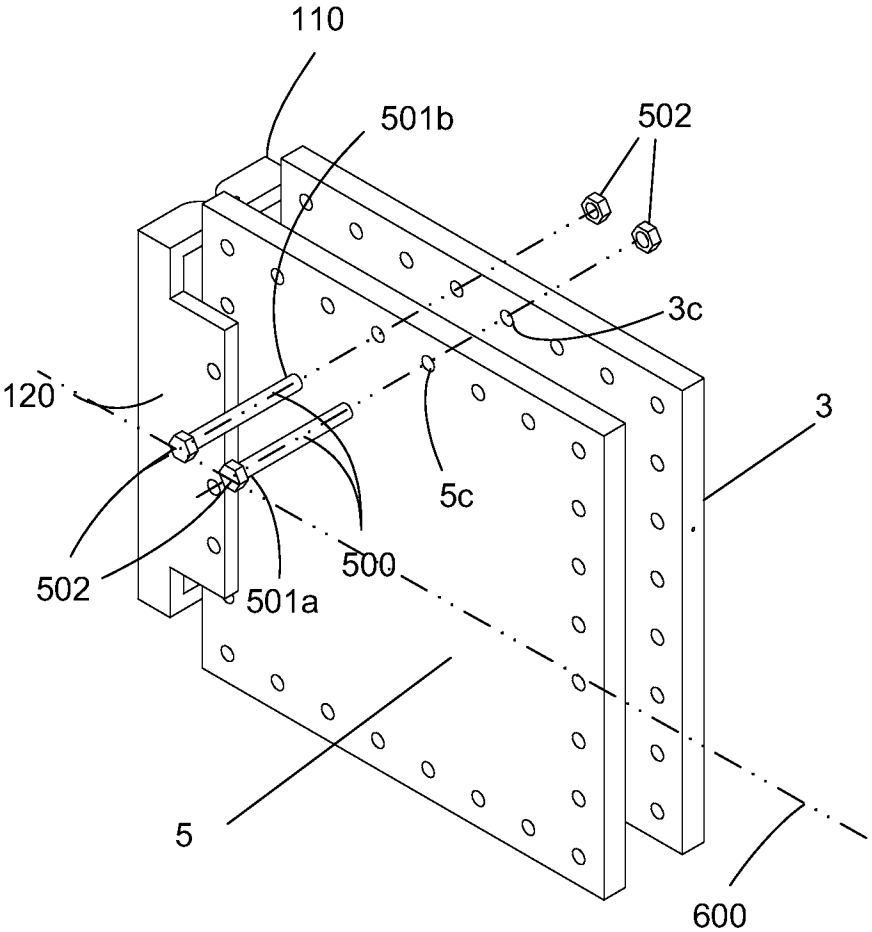
FIG. 37 is a front view of one embodiment of the extended length cover supporting rod of the present invention in at least one of the upper manway cover bolt openings above the horizontal axis of a rectangular or square manway cover.
Figure 39:
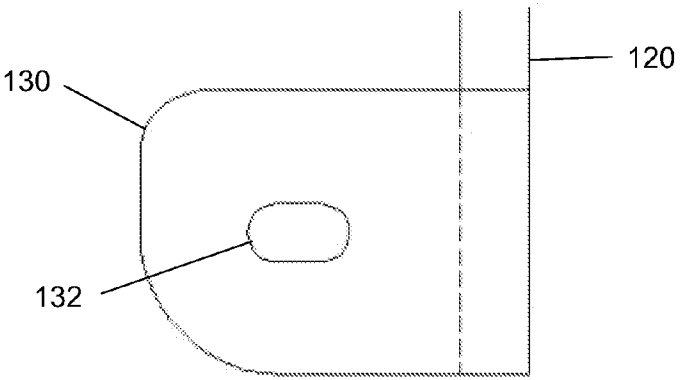
FIG. 39 is a top, enlarge view of a cover hinge flange of a cover hinge showing an elongated pivot opening.

FIG. 37 illustrates another embodiment of the present invention showing an exploded, perspective view of a rectangular/square manway flange 3, a rectangular/square manway cover 5, a flange hinge plate 110, a cover hinge plate 120, and at least one extended length cover supporting rod 500. Like the illustrations in FIGS. 35 and 36, cover supporting rod 500 extends through a flange bolt opening 3*c* and a corresponding cover bolt opening 5*c* located in an upper portion of manway cover 5 that is above the horizontal axis 600 of manway cover 5. Cover supporting rod 500 includes optional but preferred end stops 502 at each end 501*a*, 501*b*. FIG. 38 is a cross-sectional view of a pair of extended length cover supporting rods 500 connected to cover 5 and flange 3. Cover supporting rod 500 is used to support manway cover 5 after all of the remaining cover bolts are removed. Once all of the remaining cover bolts are removed, manway cover 5 is separated from manway flange 3 a predefined distance for the purpose of attaching cover hinge plate 120 and flange hinge plate 110 to cover 4 and flange 2, respectively. Similarly as previously described, cover supporting rod 500 allows the use of a pin 60 that has a transverse rod 300, a nut 66, a centering component 68, or a combination of similar fasteners and/or end stops that can be positioned at the inside surfaces (i.e. the opposing surfaces) of cover 4 and flange 2. This is more clearly shown in FIG. 36. Turning now to FIG. 39, there is illustrated a partial top view of cover hinge plate 120 and hinge flange 130. In this embodiment, hinge flange 130 has a flange opening 132 that is elongated. The elongated opening 132 provides adjustability for rotatably connecting a cover hinge plate 120 to a flange hinge plate 110. This is especially useful when pins 60 having inside nuts 66, centering components 68, transverse rods 62, or combinations thereof are used to connect the manway hinge device 100 to the manway flange 2 and manway cover 4. Elongated opening 132 minimizes the need for accurately measuring the placement of opening 132 in hinge flange 130 of cover hinge plate 120 and provides adjustability between the cover hinge plate and the flange hinge plate.

Figure 40:
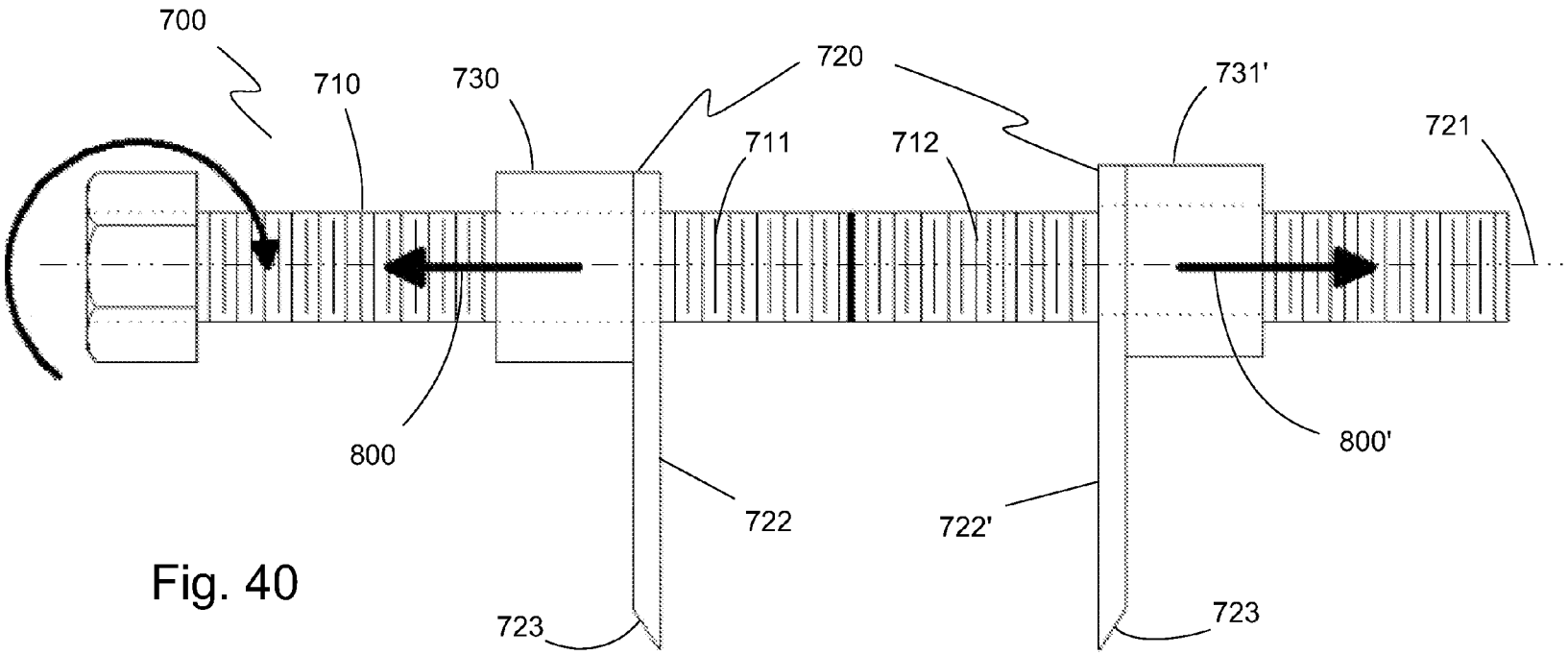
FIG. 40 is a side view of one embodiment of a flange separator of the present invention used for separating a manway cover from a manway flange.

FIG. 40 illustrates one embodiment of a flange separator 700 for use to facilitate separating cover 4 from flange 2. Flange separator 700 includes a threaded rod 710 and a separator component 720. Separator component 720 has a pair of elongated flange plates 722, 722', each connected to flange plate ends 730, 730', respectively. Flange plate ends 730, 730' are rotatably connected to threaded rod 710. Threaded rod 710 includes a first threaded portion 711 and a second threaded portion 712. Each of the first threaded portion 711 and the second threaded portion 712 form about half the length of threaded rod 710. In this embodiment, first threaded portion 711 has a right hand thread and second threaded portion 712 has a left hand thread. First threaded portion 711 supports elongated flange plate 722 while second threaded portion supports elongated flange plate 722' in a mirror-image configuration. Turning threaded rod 710 provides translational movement to elongated flange plate 722 along the longitudinal axis 721 of threaded rod 710 in the direction of arrow 800 while simultaneously providing translational movement to elongated flange plate 722' along the longitudinal axis 721 of threaded rod 710 in the direction of arrow 800'. For example, turning threaded rod 710 in a clockwise rotation causes elongated flange plates 722, 722' to move away from each other while a counter-clockwise rotation of threaded rod 710 causes elongated flange plates 722, 722' to move toward each other. It is contemplated that, to accomplish the translational movement of flange plates 722, 722' relative to each other, threaded rod 710 may optionally have only a right-hand or a left-hand thread while the flange plate ends 730, 730' may have internal right-hand threads and internal left-hand threads, respectively. In this way, rotation of threaded rod 710 will also cause elongated flange plates 722, 722' to move away from or toward each other along threaded rod 710.

Figure 40A:
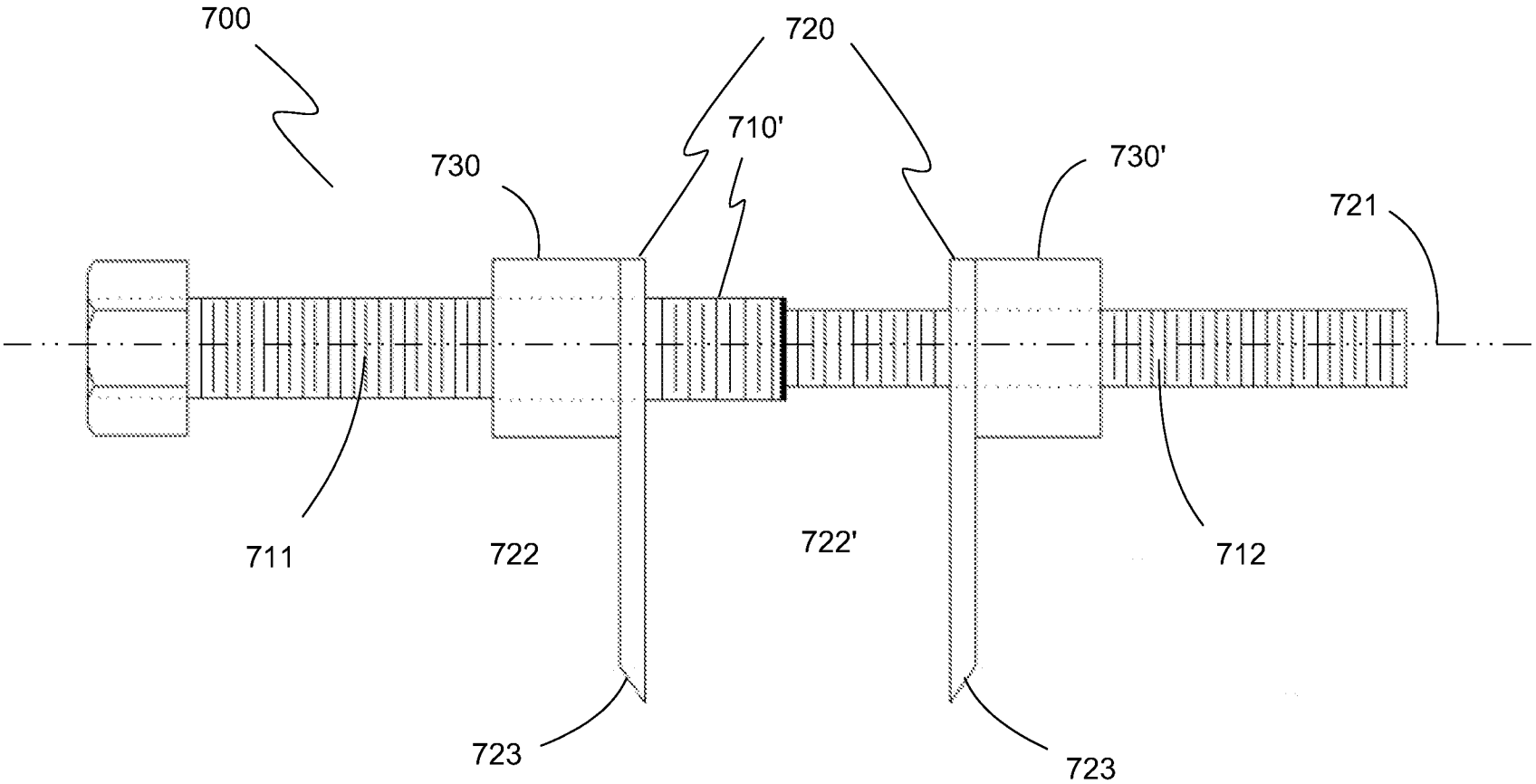
FIG. 40A is a side view of another embodiment of the flange separator of the present invention showing a threaded rod with reduced diameter portion.

FIG. 40A illustrates another embodiment of flange separator 700. In this embodiment, flange separator 700 includes a threaded rod 710' and a separator component 720. Threaded rod 710' includes a first threaded portion 711 and a second threaded portion 712. Each of the first threaded portion 711 and the second threaded portion 712 form about half the length of threaded rod 710'. In this embodiment, first threaded portion 711 has a larger diameter than second threaded portion 712. The advantage of this embodiment is it allows disposing the flange plate end 730 over second threaded portion 712 and onto first threaded portion 711 after threaded rod 710' is formed. As described above for FIG. 40, first threaded portion may have a right hand thread and second threaded portion 712 may have a left hand thread. First threaded portion 711 supports elongated flange plate 722 while second threaded portion supports elongated flange plate 722'. Turning threaded rod 710' provides translational movement to elongated flange plate 722 along the longitudinal axis 721 of threaded rod 710. Alternatively, the translational movement of flange plates 722, 722' relative to each other may be accomplished by providing threaded rod 710' with only a right-hand or a left-hand thread while the flange plate ends 730, 730' may have internal right-hand threads and internal left-hand threads, respectively.

Figure 41:
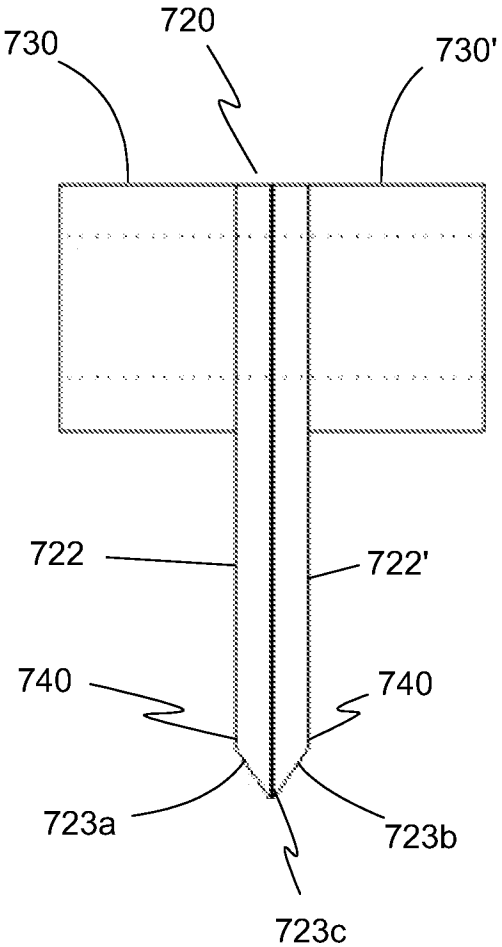
FIG. 41 is a side view of the pair of elongated flange plates positioned together forming a wedge.

FIG. 41 is a side view of separator component 720. At flange plate ends 740, 740', elongated flange plates 722, 722' have beveled edges 723*a*, 723*b*. When elongated flange plates 722, 722' are located adjacent each other and contact each other on threaded rod 710, flange plates 722, 722' form a wedge 723*c* that is used for insertion at the seam between a manway cover and a manway flange.

Figure 42:
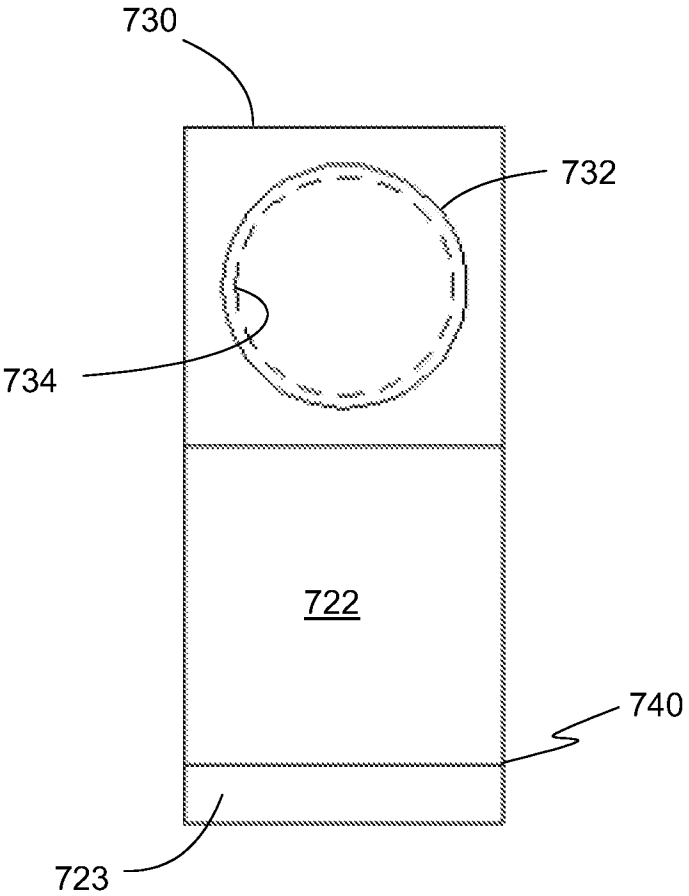
FIG. 42 is a front view of one of the pair of elongated flange plates in FIG. 41.

FIG. 42 is a front view of an elongated flange plate 722 shown in FIGS. 41 and 42. Elongated flange plate 722 has beveled edge 723 at flange plate end 740 and a rotatably interface 732 at flange plate end 730. In this embodiment, flange plate end 730 includes a threaded opening 734 that threadably receives threaded rod 710.

FIGS. 43 and 44 illustrate various embodiments of elongated flange plate 722. Turning first to FIG. 43, elongated flange plate 722 has beveled edge 723 at end 740, a rotation interface 732 at flange plate end 730 and an enclosed, flange plate opening 724 that extends through elongated flange plate 722. Enclosed flange plate opening 724 is located between beveled edge 723 and rotation interface 732. Flange plate opening 724 is sized to accommodate a cover bolt and/or the extended length cover supporting rod 500 (not shown). In an alternative embodiment of the present invention, a flange plate shown in FIG. 43 may have flange plate opening 724 with threads sized to receive a bolt that has a smaller diameter than the bolt opening 4*c* in cover 4 while flange plate 722' has no flange plate opening. The two flange plates 722, 722' would then be wedged between the cover 4 and flange 2 so that flange plate 722 with threaded flange plate opening 724 is aligned with and adjacent to one of bolt openings 4*c* in cover 4. Threaded rod 710 is then inserted through bolt opening 4*c* and threaded into flange plate opening 724 to contact flange plate 722'. Flange plate 722' acts as a stop causing flange plate 722 to force cover 4 away from flange 2 as threaded rod 710 is rotated for separating cover 4 from flange 2.

Figure 44C:
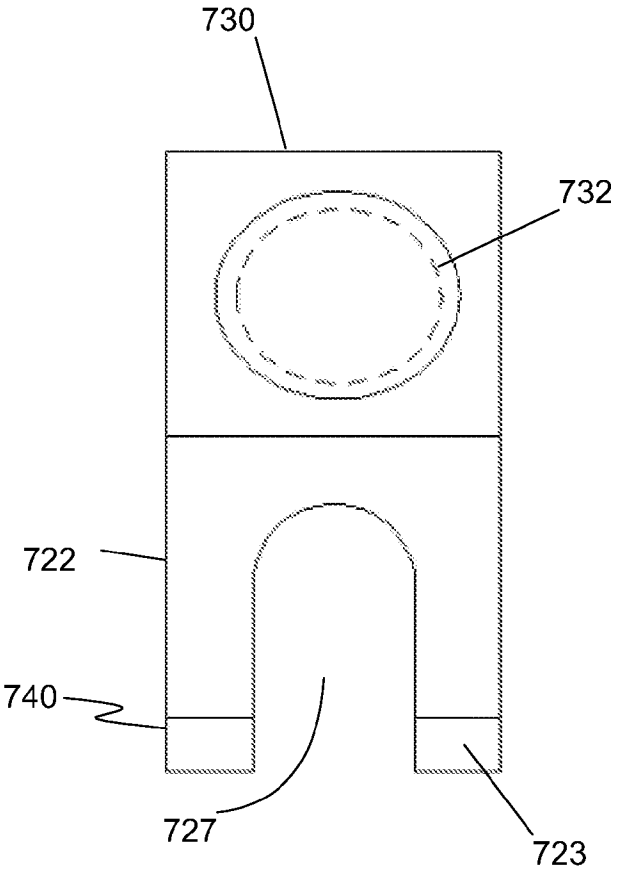

FIG. 44*a* illustrates an elongated flange plate 722 that has a beveled edge 723 at one end, a rotation interface 732 at flange plate end 730 and a side notch 725 in a side edge 722*a*. Side notch 725 is sized to accommodate at least a portion of the cross-sectional profile of a cover bolt and/or extended length cover supporting rod 500. FIG. 44*b* shows an elongated flange plate 722, a beveled edge 723 at flange plate end 740, a rotation interface 732 at flange plate end 730 and a side recess 726 in a side edge 722*a*. Side recess 726 is sized to accommodate at least a portion of the cross-sectional profile of a cover bolt and/or extended length cover supporting rod 500. FIG. 44*c* shows an elongated flange plate 722, a beveled edge 723 at flange plate end 740, a rotational interface 732 at flange plate end 730 and an end notch 727 in flange plate end 740. End notch 727 extends towards rotational interface 732 and is sized to accommodate at least a portion of the cross-sectional profile of a cover bolt and/or extended length cover supporting rod 500.

Figure 45A:
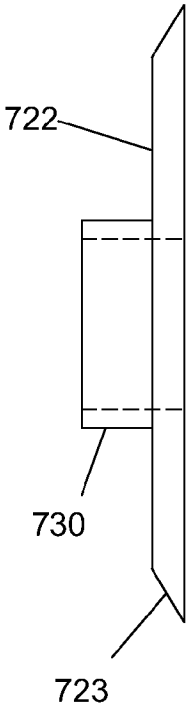
FIG. 45 is a front view of another embodiment of a flange plate of a flange separator of the present invention showing as circular flange plate with a tapered peripheral edge and a threaded opening through the body of the flange plate.
Figure 45:
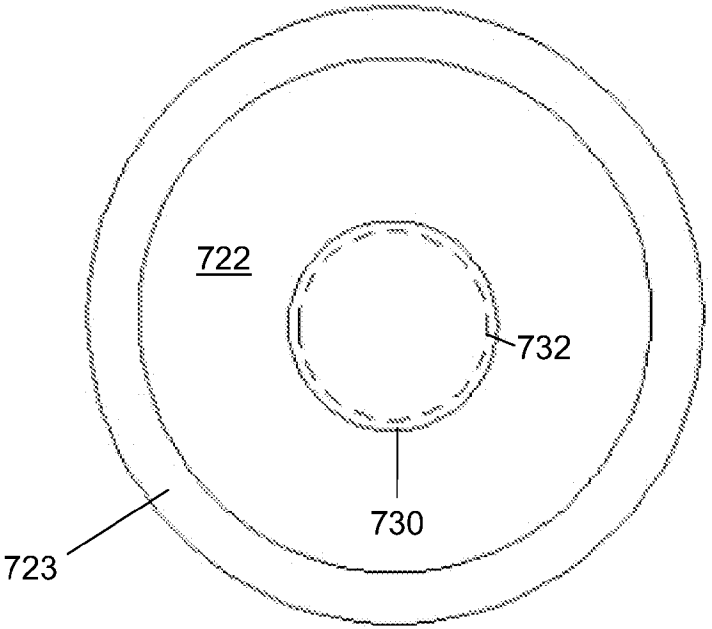

FIGS. 45 and 45A illustrated another embodiment of the flange plate 722 for use in the present invention. FIG. 45 shows a front view of a flange plate 722 that is circularly shaped with a central flange interface end 730 and a peripheral flange end 740. Central flange interface end has a rotation interface 732 at flange interface end 730 and a beveled edge 723 at peripheral flange end 740. FIG. 45A shows a side view of the embodiment in FIG. 45. The advantage of this embodiment is if the flange plate were to rotate at all while attempting separation of manway cover 4 from manway flange 2, there will always be a surface of flange plate 722 in contact with the inside surfaces of the manway cover 4 and the manway flange 2.

Figure 46:
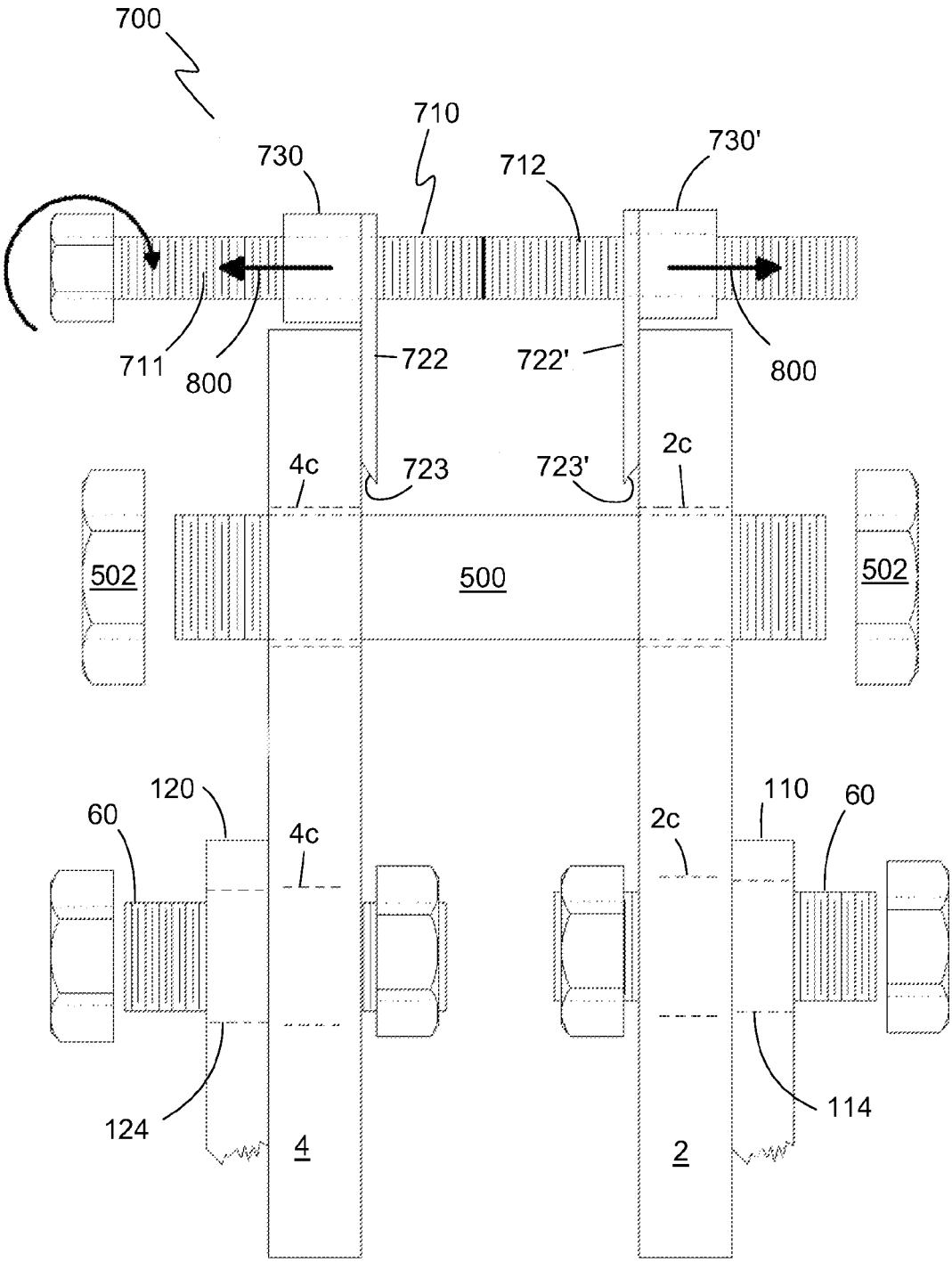
FIG. 46 is a side view of one embodiment of the present invention showing the relative positions of the cover hinge plate, the flange hinge plate, the extended length cover supporting rod, and the flange separator to the manway cover and the manway flange.

Turning now to FIG. 46, there is illustrated a partial, side view of the present invention showing one embodiment of the present inventive concept. Manway cover 4 and manway flange 2 are in a separated condition. Extended length cover supporting rod 500 is positioned within bolt openings 4*c*, 2*c* of cover 4 and flange 2, respectively, and supporting cover 4. End stops 502 are threaded nuts that are threadably attached to cover supporting rod 500 to prevent separation of cover 4 from flange 2 greater than an allowable, predefined distance. Pins 60 are located through bolt openings 4*c*, 2*c* of cover 4 and flange 2 and hinge openings 124,114 of cover hinge plate 120 and flange hinge plate 110, respectively. Pins 60 are shown in this embodiment as threaded rods with threaded nuts on each end. Flange separator 700 is located at the periphery of cover 4 and flange 2 with the faces of flange plates 722, 722' against the opposed surfaces of cover 4 and flange 2. It should be noted that flange plates 722, 722' have a shorter length so that beveled edge 723 does not contact either the cover bolts or the cover supporting rod 500. Arrows 800 indicate the relative translational movement of flange plates 722, 722' away from each other resulting in the separated condition of cover 4 and flange 2.

Figure 47:
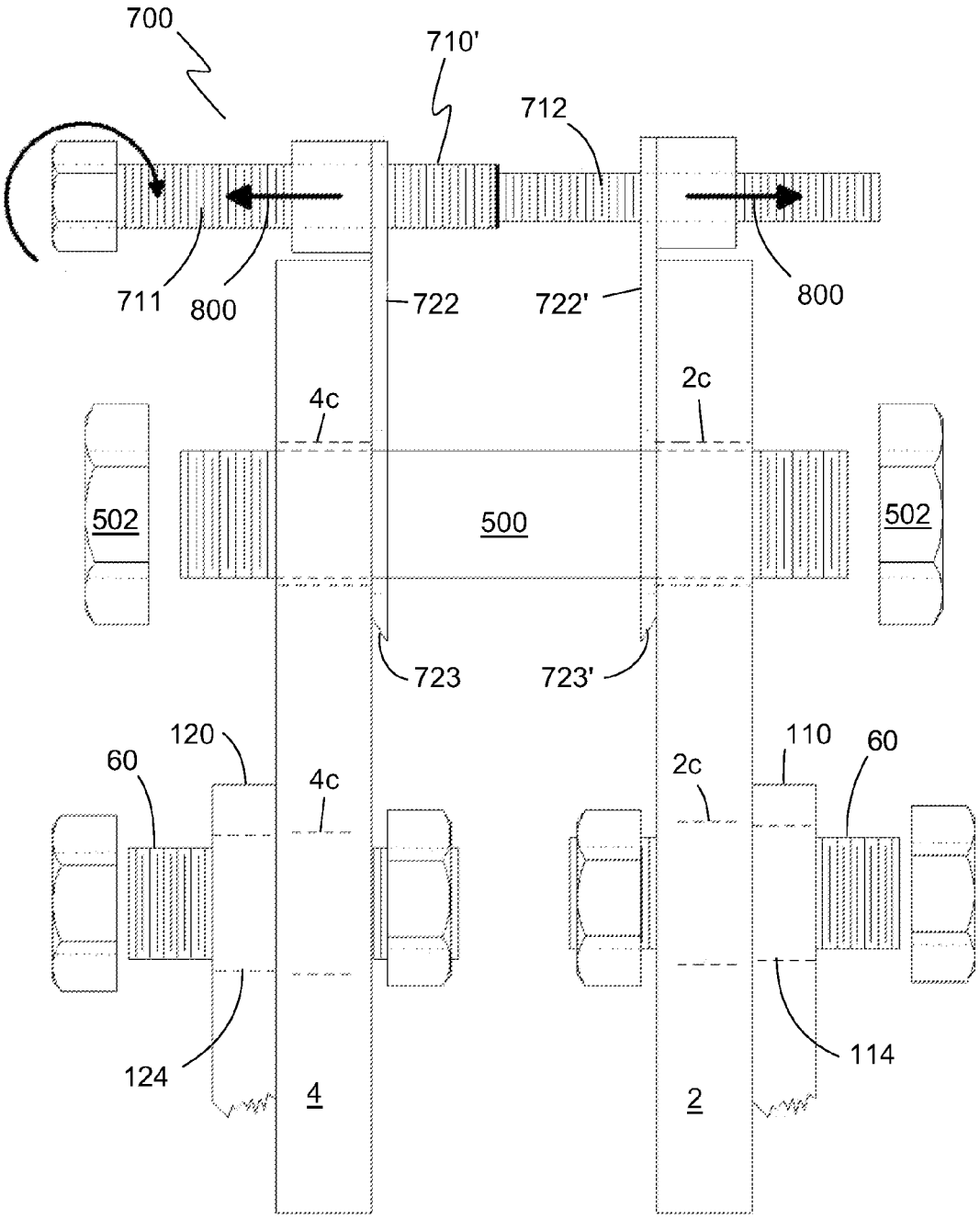
FIG. 47 is a side view of another embodiment of the present invention showing the relative positions of the cover hinge plate, the flange hinge plate, the extended length cover supporting rod, and an alternative flange separator embodiment to the manway cover and the manway flange.

FIG. 47 is similar to FIG. 46 in that there is illustrated a partial, side view of the present invention showing another embodiment of the present inventive concept. In this illustration, the only difference is in the flange separator 700. Flange separator 700 incorporates threaded rod 710' having a first threaded portion 711 that is larger in diameter than second threaded portion 712. Also, elongated flange plates 722, 722' incorporate one of a side notch 725, or a side recess 726, or an end notch 727, or an enclosed, flange plate opening 724 shown in FIGS. 43 and 44A-44C to accommodate the cross-sectional profile of cover supporting rod 500.

Figure 48:
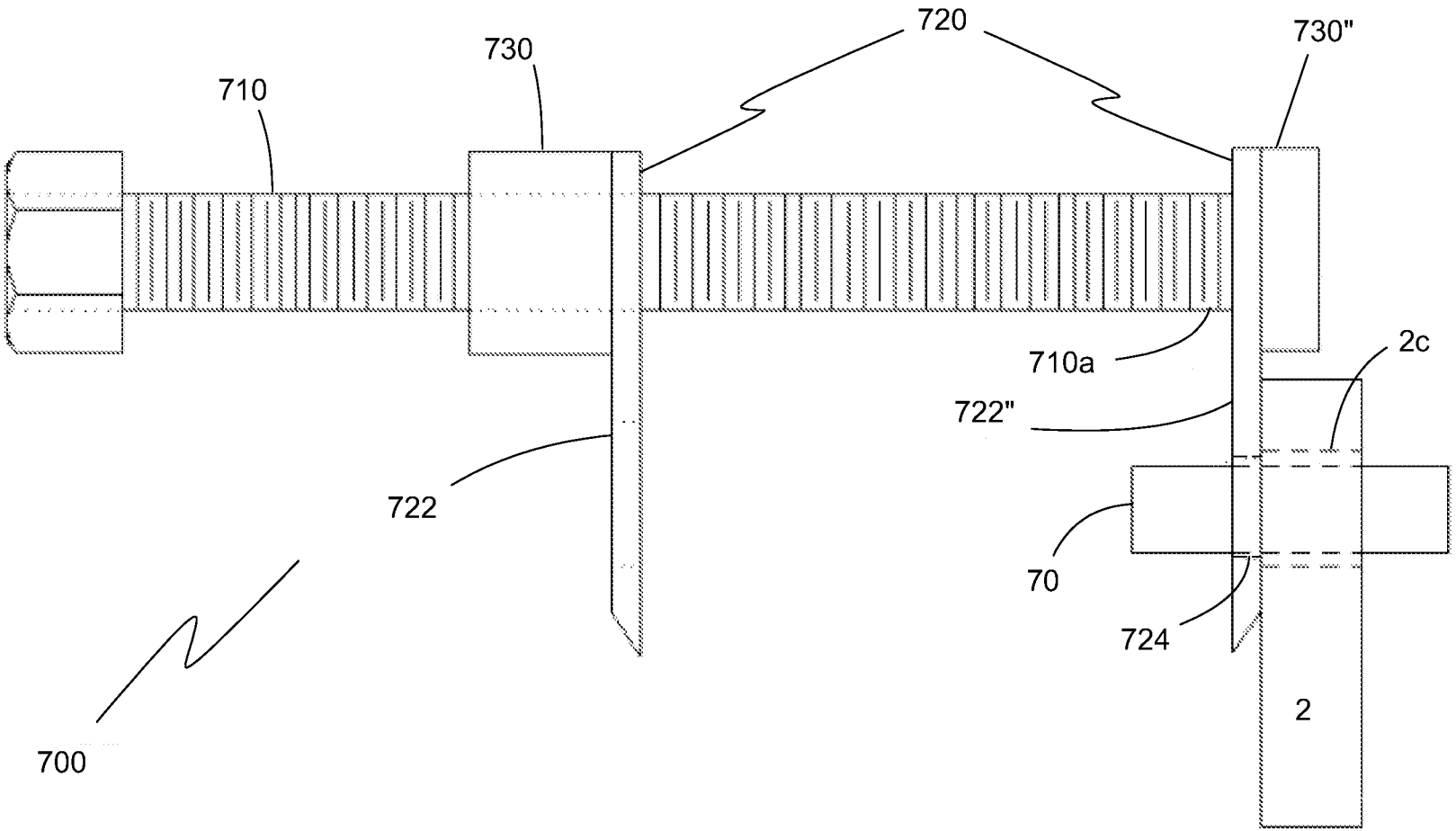
FIG. 48 is a side view of another embodiment of a flange separator of the present invention showing a pair of elongated flange plates where one is stationary and the other is movable.

FIG. 48 illustrates another embodiment of a flange separator 700. In this embodiment, flange separator 700 has a threaded rod 710 and a separator component 720. Separator component 720 has a pair of elongated flange plates 722, 722", each connected to flange plate ends 730, 730", respectively. Flange plate ends 730, 730" are rotatably connected to threaded rod 710. Threaded rod 710 supports elongated flange plate 722 while threaded rod end 710*a* rotatably contacts flange plate end 730" of elongated flange plate 722". Elongated flange plate 722" has a flange plate opening 724 that is supported by flange plate support component 70 such as a rod, bolt, stud, pin, and the like positioned in a flange bolt opening 2*c*. Because flange plate end 730" acts as an end stop surface for threaded rod end 710*a* that bears the force resulting from the separation pressure imparted by elongated flange plate 730 against manway cover 4 (not shown), the flange plate support component 70 prevents flange plate 722" from pivoting away from the inside surface of manway flange 2, which, if allowed to happen, would cause flange separator failure.

Although one or more flange separators 700 may be used to separate a manway cover 4 from a manway flange 2, it is preferred to use three of the flange separators 700 positioned approximately one hundred twenty degrees (120°) apart on a circular manway cover and four of the flange separators 700 positioned approximately ninety degrees (90°) to each other on a rectangular/square manway cover, one on each side. Although the rotation to the threaded rod 710 may be performed manually, it is preferred to use a power tool for convenience.

Although the flange separator 700 has been described in conjunction with the manway hinge 100, it should be understood that flange separator 700 may be used to separate any manway cover from a manway flange with or without the use of a manway cover handling device.

Figure 49:
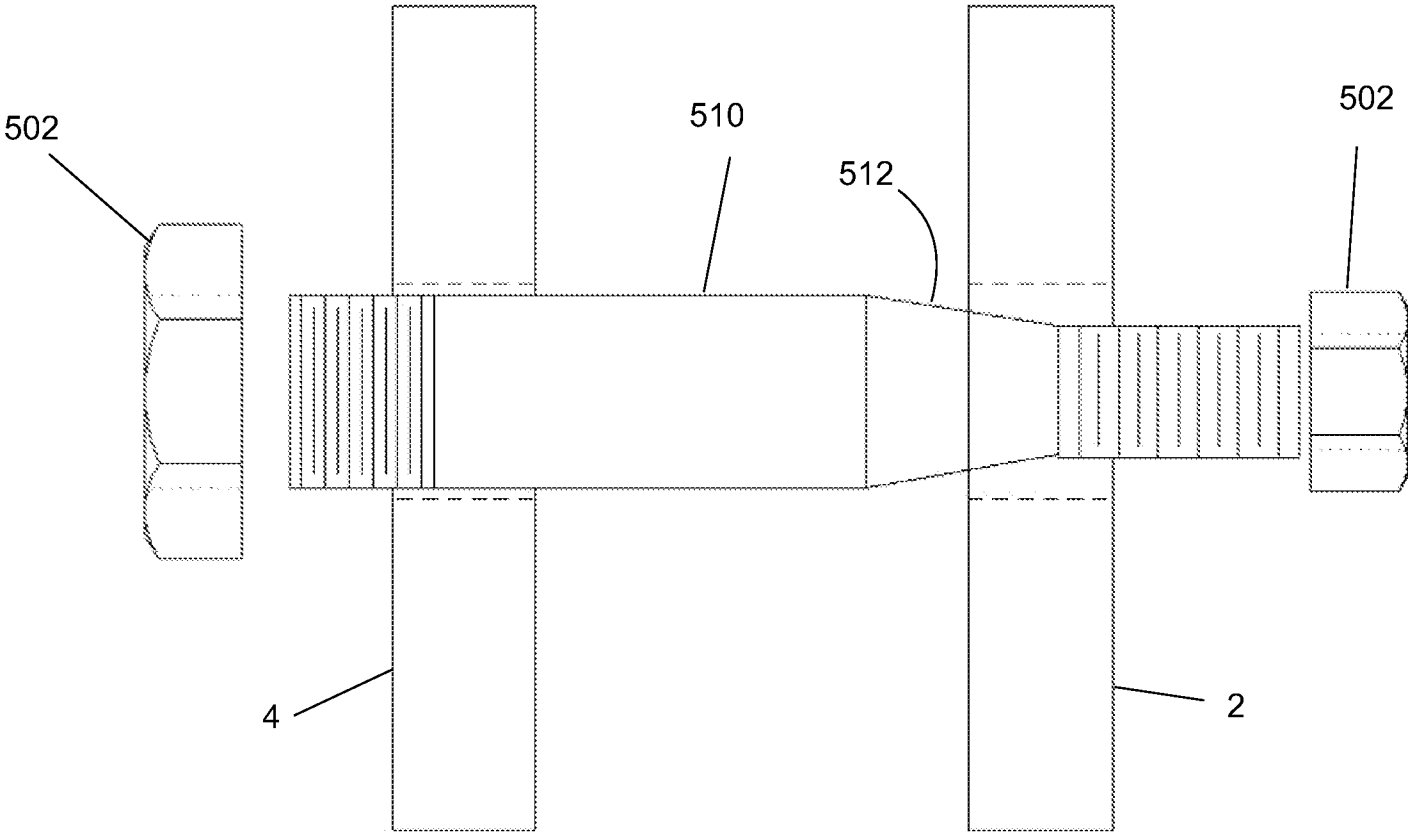
FIG. 49 is a side view of another embodiment of the present invention showing a self-centering pin or cover supporting rod.

FIG. 49 is a side view of another embodiment of pin 60 and/or cover supporting rod 500 called centering. In the embodiment illustrated, a cover supporting rod 550 is illustrated. Cover supporting rod 510 has a central portion 511, a tapered portion 512 and a reduced diameter portion 514. Cover supporting rod 510 is used for more accurately aligning the manway cover bolt openings with the manway flange bolt openings. Central portion 511 is typically substantially similar in size to but smaller than the bolt opening diameter. The reduced diameter portion 514 is at least one-eighth inches in diameter smaller than the bolt opening diameter. Tapered portion 512 provides a tapered surface upon which the edge of the bolt opening slides up as it approaches and receives the central portion 511. Because conventional bolt openings in manway covers and manway flanges are typically one-eighth of an inch larger than the securing bolts, the bolt openings in the manway cover can be as much as one-eighth of an inch out of alignment with the flange bolt openings. Although the cover supporting rod 500 has been described, it should be understood that the same configuration may be provided as a pin 60 for connecting the hinge plates 110, 120 to the flange 2 and cover 4, respectively.

Figure 50:
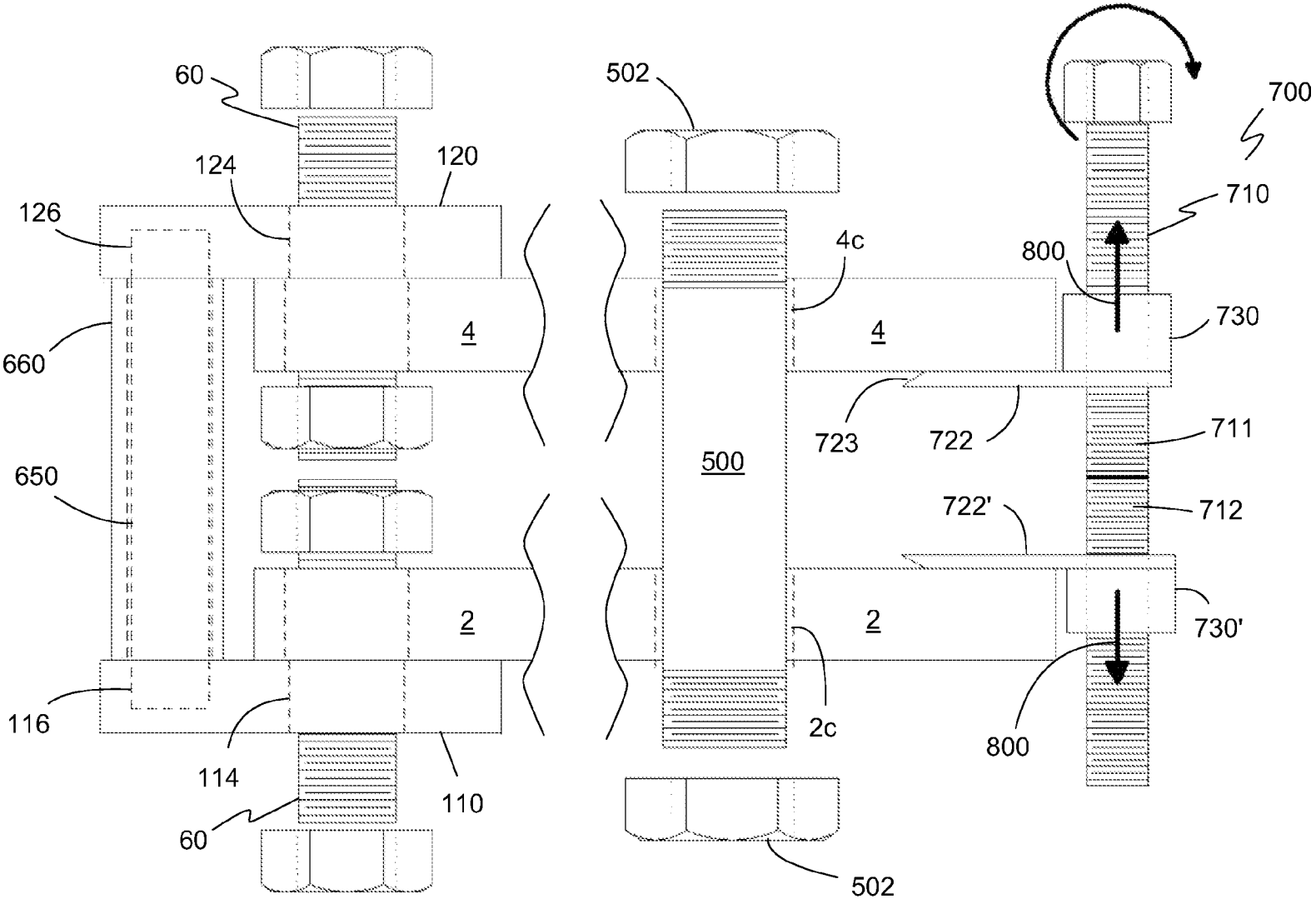
FIG. 50 is a side view of another embodiment of the present invention showing the placement of a pivoting rod and a pivot spacer for a hinge used on a horizontal manway cover.

FIG. 50 is a side view showing another embodiment of the present inventive concept on a horizontally positioned manway cover 4. Manway cover 4 and manway flange 2 are in a separated condition. Extended length cover supporting rod 500 is positioned within bolt openings 4*c*, 2*c* of cover 4 and flange 2, respectively. End stops 502 are threaded nuts that are threadably attached to cover supporting rod 500 to prevent separation of cover 4 from flange 2 greater than an allowable, predefined distance. In this embodiment, however, supporting rod 500 does not support the cover 4 but maintains the alignment of bolt openings 4*c*, 2*c*. Pins 60 are located through bolt openings 4*c*, 2*c* of cover 4 and flange 2 and hinge openings 124,114 of cover hinge plate 120 and flange hinge plate 110, respectively. Pins 60 are shown in this embodiment as threaded rods with threaded nuts on each end. Flange separator 700 is located at the periphery of cover 4 and flange 2 with the faces of flange plates 722, 722' against the opposed surfaces of cover 4 and flange 2. It should be noted that flange plates 722, 722' have a shorter length in this embodiment so that beveled edge 723 does not contact either the cover bolts or the cover supporting rod 500 but that any of the flange plate embodiments previously disclosed may be optionally used. Arrows 800 indicate the relative translational movement of flange plates 722, 722' away from each other resulting in the separated condition of cover 4 and flange 2. A pivot support rod 650 is connected to cover hinge plate 120 and flange hinge plate 110 of hinge device 10 and supports manway cover 4 in a separated condition from manway flange 2. Pivot support rod 650 has an outer tubing spacer 660 that supports manway cover 4 a predefined distance from manway flange 2. Pivot support rod 650 may be inserted through a pre-existing flange plate opening 114 and a pre-existing cover plate opening 124 while outer tubing spacer 660 has an outside diameter that is larger than the diameter of flange plate opening 114 and cover plate opening 124. Alternatively, flange hinge plate 110 and/or cover hinge plate 120 may have pivot rod receiving opening 116 and/or 126, respectively. This arrangement allows the cover to swing/pivot horizontally away from and parallel to the flange plate 2 exposing the manway by pivoting against the outer tubing spacer 660 and the pivot support rod 650. Pivot support rod outer stops 670 may optionally be attached to the outer ends of pivot support rod 650 assuming that pivot support rod 650 extends beyond cover hinge plate 120 and/or flange hinge plate 110. Alternatively, cover plate 120 and flange plate 110 may have optional blind holes 126, 116 for receiving the ends of pivot support rod 650 while outer tubing spacer 660 pivotally supports cover 4. It should be understood that the pivot support rod 650 and the outer tubing spacer 660 is properly sized for safely supporting a cover 4 depending on the size and weight of cover 4.

Figure 51:
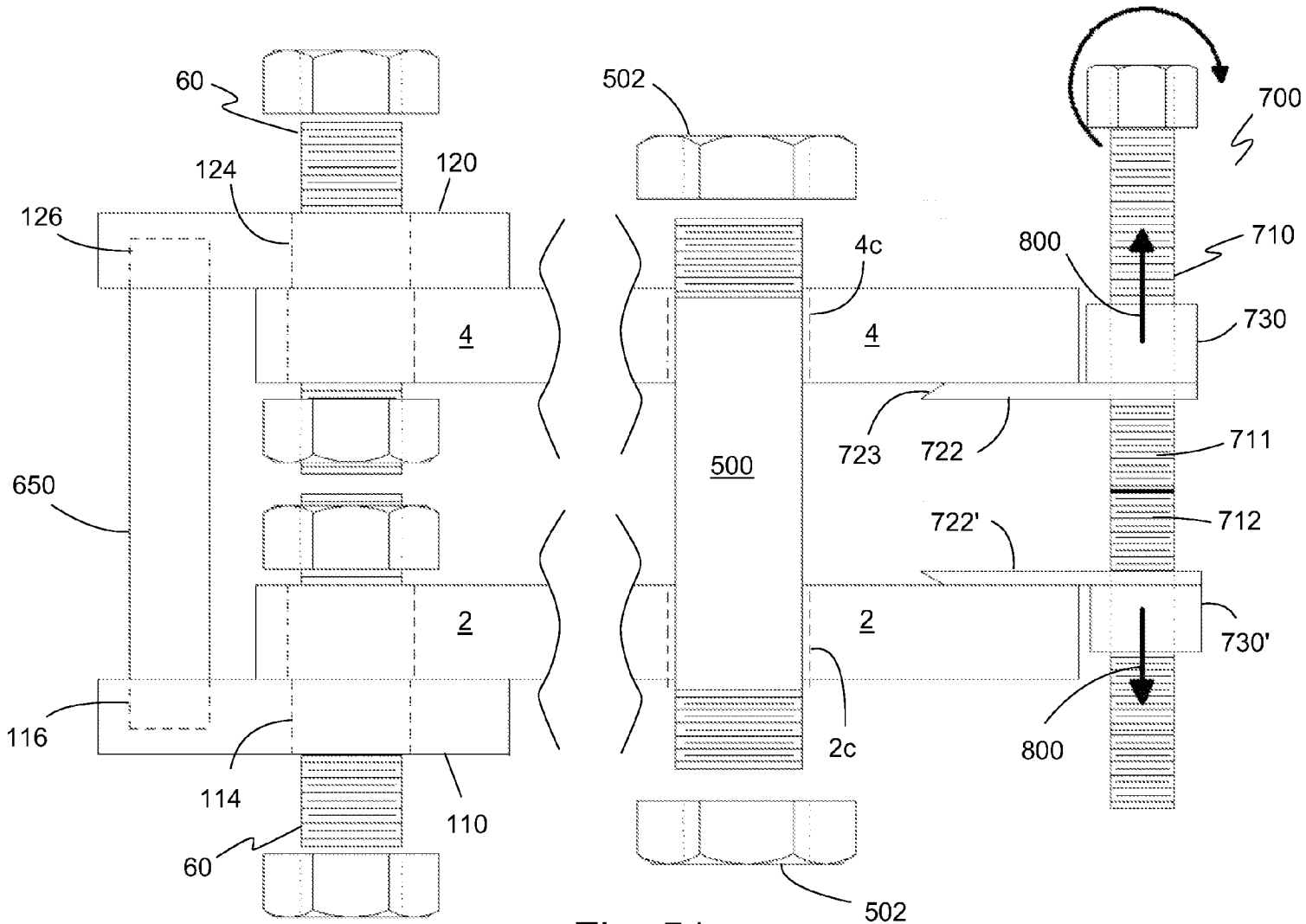
FIG. 51 is a side view of another embodiment of the present invention showing the placement of a pivoting rod for a hinge used on a horizontal manway cover.

FIG. 51 is a side view showing another embodiment of the present inventive concept on a horizontally positioned manway cover 4. As in FIG. 50, manway cover 4 and manway flange 2 are in a separated condition. Extended length cover supporting rod 500 is positioned within bolt openings 4*c*, 2*c* of cover 4 and flange 2, respectively. End stops 502 are threaded nuts that are threadably attached to cover supporting rod 500 to prevent separation of cover 4 from flange 2 greater than an allowable, predefined distance. In this embodiment, like the embodiment in FIG. 50, supporting rod 500 does not support the cover 4 but maintains the alignment of bolt openings 4*c*, 2*c*. Pins 60 are located through bolt openings 4*c*, 2*c* of cover 4 and flange 2 and hinge openings 124,114 of cover hinge plate 120 and flange hinge plate 110, respectively. Pins 60 are shown in this embodiment as threaded rods with threaded nuts on each end. Flange separator 700 is located at the periphery of cover 4 and flange 2 with the faces of flange plates 722, 722' against the opposed surfaces of cover 4 and flange 2. Arrows 800 indicate the relative translational movement of flange plates 722, 722' away from each other resulting in the separated condition of cover 4 and flange 2. A pivot support rod 650 is connected to cover hinge plate 120 and flange hinge plate 110 of hinge device 10 and supports manway cover 4 in a separated condition from manway flange 2. As illustrated, pivot support rod 650 is inserted into blind openings 116 and 126 in flange plate 110 and cover plate 120, respectively. In this embodiment, the ends of blind openings 116, 126 and pivot rod 650 maintain the distance between cover hinge plate 120 and flange hinge plate 110 a predefined distance defined solely by the length of pivot support rod 650. In an alternative embodiment, one or both openings 116, 126 may be through openings or may be one of the plurality of cover plate and/or flange plate openings 124, 114, respectively. In this alternative embodiment, pivot support rod 650 requires the use of at least one inside rod stop 652 that is disposed at a predefined position/location on pivot support rod 650 from one end when the corresponding pivot rod support opening in either the flange hinge plate 110 or the cover hinge plate 120 is a through opening. Inside rod stop 652 may be preformed in support rod 650 or attached to support rod 650 by threading, welding, and the like, or may be a machined or a cast stop shoulder formed into support rod 650. For example, support rod may be a threaded rod, a threaded rod with a middle, unthreaded portion, a pin with threaded ends and a stop shoulder adjacent a middle, unthreaded portion, a pin with a transverse stop rod through a transverse bore in the support rod advantageously positioned a predefined distance from the end of the support rod, etc. This arrangement, like that shown in FIG. 50, allows the cover to swing/pivot horizontally away from and parallel to the flange plate 2 exposing the manway opening by pivoting against the ends of pivot support rod 650 when blind openings are used or against the inside rod stop 652 when a through opening is used. Pivot support rod outer stops 670 may optionally be attached to the outer ends of pivot support rod 650 assuming that pivot support rod 650 extends beyond cover hinge plate 120 and/or flange hinge plate 110. Alternatively, cover plate 120 and flange plate 110 may have optional blind holes for receiving the ends of pivot support rod 650 while outer tubing spacer 660 pivotally supports cover 4. It should be understood that the openings in cover plate 120 and flange plate 110 used for receiving pivot support rod 650 may be blind holes, through holes, threaded blind holes, threaded through holes or combinations thereof so long as the configuration of the pivot support rod 650 with or without outer tubing spacer 660 is capable of pivotally supporting cover 4 a predefined distance from flange 2 for pivotal removal of cover 4 from flange 2 in a parallel pivoting movement.

One of the methods of using the hinge device 10 of FIGS. 1-14 of the present invention will now be explained. A plurality of bolts is removed from one portion of a manway cover 4. A support member 40 is inserted into each of the longitudinally-aligned apertures 22 of flange hinge member 20*a* and cover hinge member 20*b* such that pin receiving end 42 may be adjustably aligned with the bolt holes of the flange 2 and cover 4. A support member nut 44 is then loosely threaded on the opposite end of support member 40 of each support member 40 to prevent the separation of support member 40 from flange hinge member 20*a* and cover hinge member 20*b*. Linkage member 30 may be loosely connected to each end 21 of hinge members 20*a* and 20*b* or may be connected after hinge members 20*a* and 20*b* are connected to the flange 2 and cover 4, respectively. Because flange hinge member 20*a* is connected to the flange, flange hinge member 20*a* is considered the fixed hinge member. Linkage member 30 is pivotally connected to flange hinge member 20*a* and preferably fixedly connected to cover hinge member 20*b*.

Pin receiving ends 42 are aligned with the holes previously occupied by the flange/cover bolts. A pin 60 is inserted into each pin receiving end 42 and the bolt hole of flange 2 and cover 4 with which it is aligned. Each bolt hole will have two pins 60, one for the flange hole and one for the cover hole. The bolts that were removed from the cover may also be used as pins 60. Once inserted, support member nuts 44 are tightened drawing pin receiving ends 42 toward their respective hinge members 20*a*, 20*b*. This action causes the pins 60 to press against the bolt holes (particularly if unthreaded pins are used) and secures the hinge device 10 to the cover and flange. Once support member nuts 44 on support members 40 are sufficiently tightened and linkage member 30 securely attached (if not previously attached), the remaining manway cover bolts are removed and the cover is pivoted away from the flange. To reinstall the manway cover, the procedure is reversed. The cover is pivoted into position and a majority of the cover bolts are attached and secured before loosening the nuts 44 of support members 40 and disassembling hinge device 10. One of the many advantages of the present invention is the use of pins 60 to secure the hinge device 10 to the flange 2 and cover 4. This configuration facilitates alignment of cover 4 to flange 2 when re-installing cover 4 to flange 2.

It should be noted that the support members 40 uses a pulling-type pressure to cause the pins 60 to secure the cover and flange, i.e. the pins 60 are pulled toward hinge device 10. However, it should be understood that a pushing-type pressure can also be used by simply using a configuration such as a spacer rod. The spacer rod may be a rod, screw, bolt or any structure that acts as a spacer between the hinge members 22 and the peripheral edge of cover 4 and flange 2. An example of a preferred spacer rod is a Jack screw or expanding screw. When a Jack screw or expanding screw is used, the spacer rod also serves as a set screw. Examples of such a pushing type pressure are illustrated in US Pat. Appl. Pub. No. 2005/0242051 in FIGS. 25-32, which are incorporated herein by reference.

Locknuts may also be optionally incorporated into the present invention to prevent inadvertent loosening of the support members 40 during use. Various configurations are contemplated and are within the scope of the present invention, but each such configuration requires a support member 40 used in conjunction with a pin 60 for each cover hole and flange hole used to attach the present invention to the manway cover 4 and the manway flange 2.

Regarding the embodiments in FIGS. 15-24, a more simplified method will now be explained. A plurality of bolts is removed from one portion of a manway cover 4. A hinge plate 110 is positioned so that the hinge plate apertures 114 align with the bolt holes in the cover flange 2. In the event where the bolt holes in the cover flange 2 are blind holes or where they are unsuitable, additional holes may be formed into cover 4 and cover flange 2 that are suitable for use with the present invention. Because hinge plate 110 is connected to the flange, hinge plate 110 is considered the fixed hinge member. A pin 60 is inserted into each hinge plate aperture 114 and the bolt hole of flange 2. Likewise, a hinge plate 120 is positioned to correspond to hinge plate 110 so that the hinge plate apertures 124 align with the bolt holes in the cover 4. A pin 60 is also inserted into each hinge plate aperture 124 and the bolt hole of cover 4. Thus, each bolt hole will have two pins 60, one for the flange hole and one for the cover hole for connecting the hinge plates 110, 120 to the cover 4 and cover flange 2. It is also contemplated that each hinge plate may optionally have any number of hinge apertures to provide additional connection points to the cover and flange. Pins 60 are preferably expandable plugs or bolts. A pivot connection 150 may be attached to the overlapping and corresponding linkage members of hinge plates 110, 120 before attaching hinge plates 110, 120 to the cover and the cover flange or after attaching hinge plates 110, 120 to the cover and the cover flange. The preferred method is to connect hinge plates 110, 120 to each other using pivot connection 150 before attaching to the cover and cover flange. Once hinge plates 110, 120 are sufficiently secured to the cover and cover flange, the remaining manway cover bolts are removed and the cover is pivoted away from the flange.

To reinstall the manway cover, the procedure is reversed. The cover is pivoted into position and a majority of the cover bolts are attached and secured before removing pins 60 from hinge plates 110, 120 and disassembling hinge device 100. One of the many advantages of the present invention is the use of pins 60 to secure the hinge device 10 or 100 to the flange 2 and cover 4. This configuration facilitates alignment of cover 4 to flange 2 when re-installing cover 4 to flange 2. It is also contemplated that the present invention may also be left in place on cover 4 and flange 4 after reinstalling cover 4. To accomplish this, a longer stud is inserted through the hinge plate apertures of hinge plate 110 and corresponding hinge plate 120 and the cover and cover flange holes sufficient to attach stud nuts for securing the cover to the flange. To open cover 4 using hinge device 100, a user simply removes the stud nuts and the longer studs from the hinge apertures 114, 124 and re-inserts pins 60 before removing the remaining bolts from cover 4 and cover flange 2.

Use the combination of the hinge device 100, extended length cover supporting rods 500 and flange separator 700 will now be described. In the embodiment where a manway cover is vertically positioned, a plurality of cover bolts are removed preferably from the top of cover 4 and extended length cover supporting rods 500 are inserted into the bolt openings exposed in cover 4 and flange 2 when the cover bolts are removed. Preferably, two cover supporting rods 500 are used. End stops 502 such as nuts are threaded onto the exposed ends of cover supporting rods 500 that extend beyond the cover 4 and the flange 2. Once the cover supporting rods 500 are installed, the remaining cover bolts are removed from cover 4. Although the use of flange separator 700 is not required, it is preferred for ease and convenience. Preferably, three flange separators 700 are used for circularly shaped covers and they will be preferably positioned approximately 120° apart. Preferably four flange separators 700 are used for a rectangularly/squarely shaped manway cover 4 and they will be preferably positioned approximately 90° apart. The elongated flange plates 722, 722' are assembled onto the threaded rod 710 so that they are back to back at approximately at the center of threaded rod 710 with the beveled edges 723 forming a wedge. The wedge formed by the beveled edges 723 is forced between the cover 4 and flange 2 at the preferred spatial separation described earlier. After inserting all three flange separators 700, each threaded rod 710 is rotated clockwise in an incremental and sequential fashion moving from one flange separator 700 to another. As each separator 700 is rotated, the cover is forcibly separated from flange 2 by the translational movement of the elongated flange plates 722, 722' away from each other. Upon reaching the predefined distance of separation of cover 4 from flange 2, the flange separators 700 are removed. The hinge device 100 is then attached to cover 4 and flange 2. Flange hinge plate 110 of the hinge device 100 is positioned against either the inside or outside surface of flange 2 and at least one hinge opening of flange hinge plate 110 is aligned with a bolt opening 2*c* in flange 2. A hinge fastening pin is inserted through the hinge opening and through aligned bolt opening. A fastener such as a nut is attached to the fastening pin and hand tightened. Similarly, the cover hinge plate 120 is connected to cover 4. Once a sufficient number of hinge fastening pins have been connected to both the flange hinge plate 110 and the cover hinge plate 120, the hinge fastening pins are tightened. Hinge plate flanges 130 are then pivotally connected to each other. Cover supporting rods 500 are then removed and cover 4 can freely rotate away from flange 2 on hinge device 100.

In the embodiment where the manway cover is horizontally positioned, a plurality of cover bolts are removed from cover 4 and extended length cover supporting rods 500 are inserted into the bolt openings exposed in cover 4 and flange 2 when the cover bolts are removed. Preferably, three cover supporting rods 500 are used for circularly shaped covers and four are used for rectangularly/squarely shaped covers. Supporting rods 500 are positioned to evenly and safely allow cover 4 to separate from flange 2. End stops 502 such as nuts are threaded onto the exposed ends of cover supporting rods 500 that extend beyond the cover 4 and the flange 2. Once the cover supporting rods 500 are installed, the remaining cover bolts are removed from cover 4. Although the use of flange separator 700 is not required, it is preferred for ease and convenience. Preferably, three flange separators 700 are used for a circular manwar cover 4 and they will be positioned approximately 120° apart. Preferably, four flange separators 700 are used for a rectangular/square manway cover 4 and they will be positioned approximately 90° apart. The elongated flange plates 722, 722' are assembled onto the threaded rod 710 so that they are back to back at approximately at the center of threaded rod 710 with the beveled edges 723 forming a wedge. The wedge formed by the beveled edges 723 is forced between the cover 4 and flange 2 at the preferred spatial separation described earlier. After inserting all flange separators 700, each threaded rod 710 is rotated clockwise in an incremental and sequential fashion moving from one flange separator 700 to another. As each separator 700 is rotated, the cover is forcibly separated from flange 2 by the translational movement of the elongated flange plates 722, 722' away from each other. Upon reaching the predefined distance of separation of cover 4 from flange 2, the hinge device 100 is then attached to cover 4 and flange 2. Flange hinge plate 110 of the hinge device 100 is positioned against either the inside or outside surface of flange 2 and at least one hinge opening of flange hinge plate 110 are aligned with a bolt opening 2*c* in flange 2. A hinge fastening pin is inserted through the hinge opening and through the aligned bolt opening. A fastener such as a nut is attached to the fastening pin and hand tightened. Pivot support rod 650 (and, optionally, outer tubing spacer 660 when the pivot support rod and opening configuration requires a tubing spacer) is positioned within pivot rod receiving opening 116 in flange hinge plate 110. Similarly, the cover hinge plate 120 is positioned so that pivot rod receiving opening 126 in cover hinge plate 120 receives pivot support rod 650 and then cover hinge plate 120 is connected to cover 4 by positioning cover hinge plate 4 against either the inside or outside surface of cover 4 and at least one hinge opening of cover hinge plate 120 is aligned with a bolt opening 4*c* in cover 4. Once a sufficient number of hinge fastening pins have been connected to both the flange hinge plate 110 and the cover hinge plate 120 for safe operation, the hinge fastening pins are tightened. Cover supporting rods 500 and flange separators 700 are then removed and cover 4 can freely rotate away from and parallel to flange 2 on pivot support rod 650 (and outer tubing spacer 660 when used).

The present invention provides a simplified method and device for removing manway covers, as defined herein. The present invention is portable and capable of being installed and used by a single person. The various optional features provide, in a single device, the ability to accommodate multiple flange geometries in terms of cover diameters, bolt hole spacings and cover/cover flange thicknesses. Additionally, the present invention has relatively few component parts providing for a simple yet effective and easily assembled and transportable device for removing manway covers. Furthermore, the extended length cover supporting rods and/or the flange separator provide for additional each of use and additional options for removing and installing manway covers.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A manway cover-manway flange separating kit for use with a manway cover handling device, the kit comprising:

at least one extended length cover supporting rod having end stops at each end of the cover supporting rod wherein at least one of the end stops is removable and wherein the cover supporting rod is adapted for positioning within one of a plurality of transverse bolt openings in a manway cover and a manway flange that are exposed by the removal of a plurality of manway cover bolts from the manway cover and the manway flange and for maintaining substantial alignment of the manway cover and the manway flange when the remaining plurality of manway cover bolts are removed, the cover supporting rod having a length sufficient to maintain the alignment when the manway cover is a predefined distance away from the manway flange; and a flange separator comprising a separator component having a threaded rod and a pair of elongated flange plates, the pair of elongated flange plates rotatably connectable on a first flange plate end to the threaded rod wherein at least one of the pair of elongated flange plates has a threaded opening at the first flange plate end transverse to the flange plate for receiving the threaded rod and providing translational movement of the flange plate along the threaded rod, the flange plate portion extending from the first flange plate end adapted for placement between opposing surfaces of the manway cover and the manway flange.

2. The manway cover-manway flange separating kit of claim 1 wherein the at least one extended length cover supporting rod has a central portion with a diameter that is substantially similar in size but smaller than the diameter of the bolt opening, a threaded reduced diameter portion that is about one-eighth inches in diameter smaller than the central portion, and a tapered portion extending between the central portion and the reduced diameter portion.

3. The manway cover-manway flange separating kit of claim 1 wherein the threaded rod of the flange separator includes a first threaded portion having one of a right hand thread or a left hand thread, and a second threaded portion having one of the other of a right hand thread or a left hand thread when compared to the first threaded portion.

4. The manway cover-manway flange separating kit of claim 3 wherein the second threaded portion has smaller diameter than the first threaded portion.

5. The manway cover-manway flange separating kit of claim 1 wherein each of the pair of elongated flange plates has a second flange plate end with a bevel wherein the pair of elongated flange plates form a wedge when assembled adjacent to and in mirror-image orientation to each other.

6. The manway cover-manway flange separating kit of claim 1 wherein at least one of the pair of elongated flange plates of the separator component of the flange separator has an enclosed flange plate opening that extends through the at least one of the pair of elongated flange plates between a first flange plate end and a second flange plate end.

7. The manway cover-manway flange separating kit of claim 1 wherein at least one of the pair of elongated flange plates of the separator component of the flange separator has a side notch or recess to accommodate at least a portion of a cross-sectional profile of the cover supporting rod.

8. The manway cover-manway flange separating kit of claim 1 wherein at least one of the pair of elongated flange plates of the separator component of the flange separator has an end notch in a second flange plate end that extends a predefined distance towards a first flange plate end and accommodates at least a portion of a cross-sectional profile of the cover supporting rod.

9. The manway cover-manway flange separating kit of claim 1 wherein at least one of the pair of flange plates of the separator component of the flange separator is circularly shaped wherein a first flange plate end is centrally located on the circularly shaped flange plate and a second flange plate end is a peripheral edge of the circularly shaped flange plate, the peripheral edge being a beveled edge.

10. The manway cover-manway flange separating kit of claim 1 further comprising:

a pair of removable hinge plates wherein one of the pair of hinge plates has a support member with a hinge aperture configured for alignment with one of a plurality of transverse bolt openings of a manway cover and the other of the pair of hinge plates has a support member with a hinge aperture configured for alignment with one of a plurality of transverse bolt openings of a manway flange;

a linkage member adjacent a first end of each hinge plate of the pair of removable hinge plates and extending transversely out of the plane of the hinge plate wherein the linkage member of one of the pair of hinge plates overlaps with the linkage member of the other of the pair of hinge plates; and a pivotal connection coupling overlapping pairs of the linkage member of the pair of hinge plates.

11. The manway cover-manway flange separating kit of claim 10 further comprising a pivot support rod adapted for connecting to each of the pair of removable hinge plates and imparting relative rotational between the pair of removable hinge plates.

12. The manway cover-manway flange separating kit of claim 11 further comprising an outer tubing spacer disposed around the pivot support rod and configured to support the manway cover a predefined distance from the manway flange.

13. A method of handling the removal and installation of a manway cover to a manway flange, the method comprising:

providing at least one extended length cover supporting rod having end stops at each end wherein at least one of the end stops is removable;

removing a plurality of manway cover bolts from a first portion of the manway cover exposing a plurality of manway cover bolt openings and a plurality of manway flange bolt openings aligned therewith, the plurality of manway cover bolts being transverse to the plane of and through the manway cover;

inserting the at least one extended length cover supporting rod with the removable end stop removed into and through one of the plurality of manway cover bolt openings of a first portion that are exposed by the removal of the plurality of manway cover bolts, through the corresponding manway flange bolt opening and attaching the removable end stop to the at least one extended length cover supporting rod;

removing the remaining manway cover bolts from the manway cover;

separating the manway cover a predefined distance from the manway flange;

providing a flange hinge plate of a portable manway cover hinge device, the flange hinge plate having at least one hinge plate aperture therethrough;

aligning the at least one hinge aperture of the flange hinge plate with a bolt opening in the manway flange;

inserting a pin first end of a hinge plate fastening pin through the at least one hinge aperture and into the aligned bolt opening in the manway flange;

securing the flange hinge plate to the manway flange;

providing a cover hinge plate of a portable manway cover hinge device, the cover hinge plate having at least one hinge plate aperture therethrough;

aligning the at least one hinge aperture of the cover hinge plate with a bolt opening in the manway cover;

inserting a pin first end of another hinge plate fastening pin through the at least one hinge aperture and into the aligned bolt opening in the manway cover;

securing the cover hinge plate to the manway cover;

rotatably connecting the flange hinge plate to the cover hinge plate; and removing the extended length cover supporting rod from the manway cover and the manway flange to permit the manway cover to move away from the manway flange.

14. The method of claim 13 wherein the manway cover separating step includes inserting a separator component of a flange separator between the manway flange and the manway cover, the flange separator comprising a threaded rod and a separator component having a pair of elongated flange plates rotatably connected on one end to the threaded rod wherein at least one of the pair of elongated flange plates has a threaded opening at the one end transverse to the flange plate that receives the threaded rod to provide translational movement of the flange plate along the threaded rod, and turning the threaded rod causing translational movement of the flange plate forcing separation between the pair of elongated flange plates that causes the manway cover to slide away from the manway flange along the at least one extended length cover supporting rod toward the end stop.

15. The method of claim 14 wherein the flange separator providing step includes forming the separator component wherein each of the pair of elongated flange plates has a threaded opening at one end adapted to cause each of the pair of elongated flange plates to move along the threaded rod either towards each other or away from each other depending on the directional rotation of the threaded rod.

16. The method of claim 15 wherein the flange separator forming step includes forming a threaded rod having a right-hand thread along a first portion of the threaded rod and a left-hand thread along a second portion of the threaded rod wherein each of the first portion and the second portion engages one of the pair of elongated flange plates.

17. The method of claim 15 wherein the flange separator forming step includes forming a right-hand threaded opening in one of the pair of elongated flange plates and a left-hand thread opening in the other of the pair of elongated flange plates.

18. The method of claim 15 wherein the flange separator forming step includes forming one of a notch or an opening in a side of at least one of the pair of elongated flange plates.

19. The method of claim 15 wherein the flange separator forming step includes forming a taper at an end of each of the pair of elongated flange plates opposite the end with the threaded opening wherein, when the pair of elongated flange plates are located adjacent to and contact each other, the combination of the ends with the taper of each of the pair of elongated flange plates forms a wedge for inserting between the manway cover and the manway flange.

20. The method of claim 13 wherein the flange hinge plate and the cover hinge plate connecting step includes forming an elongated opening in each of the transverse plate flanges that extend in the same direction from opposite ends of the cover hinge plate and wherein each of the transverse plate flanges matingly receives one of the transverse plate flanges of the flange hinge plate, the transverse plate flanges of the flange hinge plate having a pivot receiving opening and which extend in the same direction from opposite ends of the flange hinge plate, and inserting a pivot post into the elongated opening and the pivot receiving opening that are matingly received to each other.

* * * * *